US011466398B2

(12) United States Patent
Lee et al.

(10) Patent No.: US 11,466,398 B2
(45) Date of Patent: Oct. 11, 2022

(54) LAUNDRY TREATING APPARATUS

(71) Applicant: LG Electronics Inc., Seoul (KR)

(72) Inventors: Youngjoo Lee, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 16/751,291

(22) Filed: Jan. 24, 2020

(65) Prior Publication Data

US 2021/0017696 A1 Jan. 21, 2021

(30) Foreign Application Priority Data

Jul. 15, 2019 (KR) ..... 10-2019-0085057

(51) Int. Cl.
*H05B 6/10* (2006.01)
*D06F 58/26* (2006.01)
(Continued)

(52) U.S. Cl.
CPC ..... *D06F 58/26* (2013.01); *D06F 39/04* (2013.01); *D06F 58/04* (2013.01); *H05B 6/102* (2013.01);
(Continued)

(58) Field of Classification Search
CPC ..... H05B 6/10; H05B 6/101; H05B 6/102; H05B 6/108; H05B 6/36; H05B 6/365; H05B 2206/022; D06F 58/02; D06F 58/04; D06F 58/10; D06F 58/16; D06F 58/206; D06F 58/24; D06F 58/26; D06F 58/28;
(Continued)

(56) References Cited

U.S. PATENT DOCUMENTS

2007/0256322 A1* 11/2007 Kim ..... D06F 58/26 34/607
2019/0048509 A1 2/2019 Kim et al.

FOREIGN PATENT DOCUMENTS

CN 202030957 11/2011
CN 202551398 11/2012
(Continued)

OTHER PUBLICATIONS

Extended European Search Report in European Application No. 19204325.5, dated Apr. 1, 2020, 5 pages.
PCT International Search Report in International Application No. PCT/KR2019/-13682, dated Apr. 10, 2020, 11 pages.
(Continued)

*Primary Examiner* — Hung D Nguyen
(74) *Attorney, Agent, or Firm* — Fish & Richardson P.C.

(57) ABSTRACT

A laundry treating apparatus includes a cabinet, a drum provided inside the cabinet and formed of a metal material, and an induction module configured to heat the drum, The induction module includes a base housing for accommodating a coil, and a cover housing forming a moving space of heat generated from the coil, jointed to an upper portion of the base housing, the cover housing includes a through portion for discharging the heat by passing through the cover housing up and down, and the cover housing forms a section upwardly inclined toward the through portion to move the heat generated from the coil along the inclined section and discharge the heat to the through portion. It is possible to prevent a temperature of the coil from being excessively increased, and enhance durability and efficiency of the induction module by active discharge of heat generated from the coil.

20 Claims, 15 Drawing Sheets

(51) Int. Cl.
*D06F 39/04* (2006.01)
*D06F 58/04* (2006.01)
*H05B 6/36* (2006.01)

(52) U.S. Cl.
CPC ..... *H05B 6/365* (2013.01); *H05B 2206/022* (2013.01)

(58) Field of Classification Search
CPC ..... D06F 58/30; D06F 58/50; D06F 39/04; D06F 39/088; D06F 37/04; D06F 37/12; D06F 37/26; D06F 37/267; D06F 37/42; D06F 25/00
USPC ..... 219/600, 601, 635, 645, 660, 672, 219/675–677; 34/132, 245–248, 251, 34/254, 278, 595, 602, 603
See application file for complete search history.

(56) References Cited

FOREIGN PATENT DOCUMENTS

| | | | | |
|---|---|---|---|---|
| DE | 102016110859 | | 6/2017 | |
| DE | 102016110859 | B3 * | 6/2017 | |
| DE | 102018102003 | A1 * | 8/2019 | |
| EP | 1914339 | | 4/2008 | |
| EP | 1914339 | A1 * | 4/2008 | ..... D06F 37/267 |
| EP | 3246457 | A1 * | 11/2017 | ..... D06F 58/26 |
| EP | 3441514 | | 2/2019 | |
| EP | 3505674 | | 7/2019 | |
| JP | 2017188475 | | 10/2017 | |
| WO | 2009112357 | | 9/2009 | |

* cited by examiner

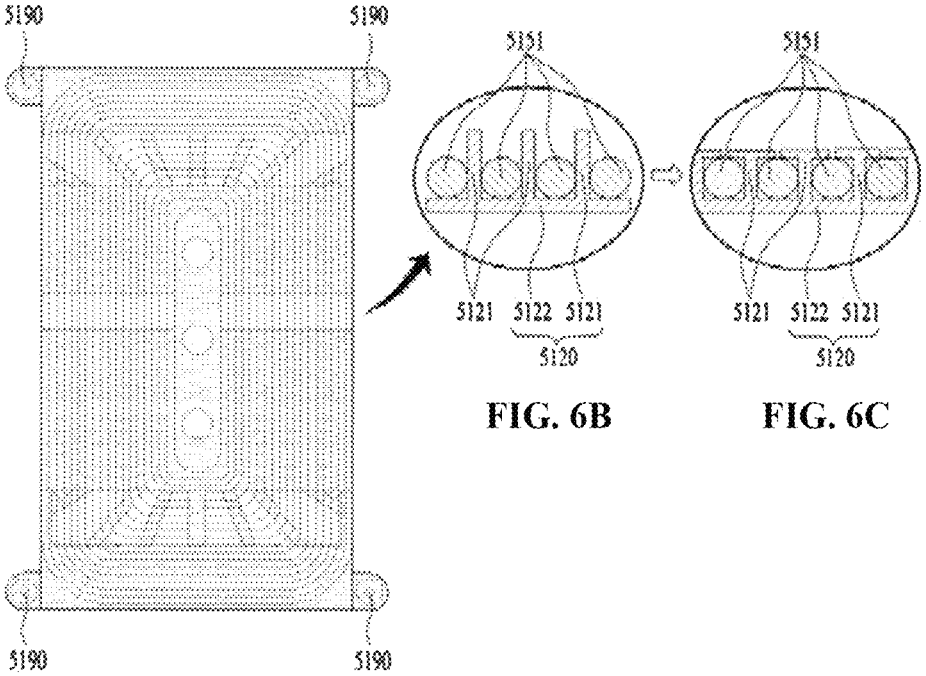
FIG. 6A
FIG. 6B
FIG. 6C
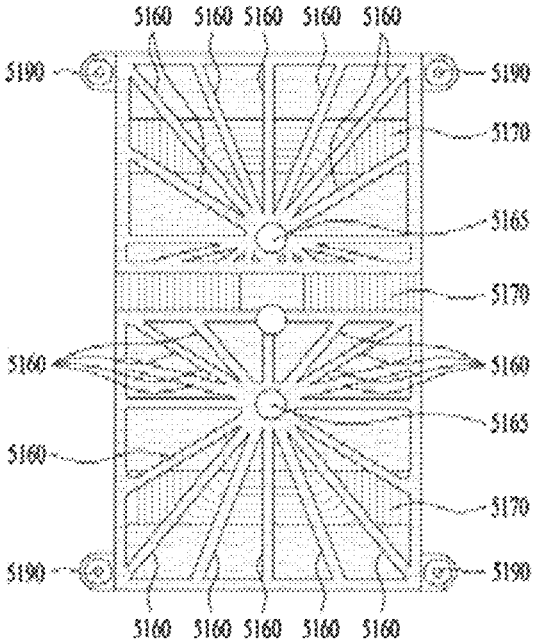
FIG. 6D

LAUNDRY TREATING APPARATUS

CROSS-REFERENCE TO RELATED APPLICATIONS

This application claims the benefit of the Korean Patent Application No. 10-2019-0085057, filed on Jul. 15, 2019, which is hereby incorporated by reference as if fully set forth herein.

BACKGROUND OF THE INVENTION

Field of the Invention

The present disclosure relates to a laundry treating apparatus.

Discussion of the Related Art

Generally, a laundry treating apparatus includes various types such as a washing machine for laundry washing, a washing machine for drying, and a refresher for refresh.

In a laundry treating apparatus, washing means a process of removing contaminants on clothes by using mechanical action of water and detergent, and drying means a process of removing water contained in laundry.

In a washing process, if washing is performed using washing water of high temperature, more detergents may be dissolved, whereby contaminants on laundry may be removed more easily and at the same time, laundry may be sterilized. Therefore, it is preferable to wash laundry put in the laundry treating apparatus by increasing a temperature of washing water within the range that deformation (for example, shrinkage, distortion, waterproof failure) of the laundry is not generated.

In the related art, it is general that the laundry treating apparatus is externally supplied with hot water to increase a temperature of washing water which is in contact with laundry, or hot water is supplied to a tub by allowing washing water to be in contact with a hot wire provided in the laundry treating apparatus.

In the case that the laundry treating apparatus is externally supplied with hot water, an external boiler should be driven separately, whereby a problem occurs in that energy is consumed. In the case that the laundry treating apparatus is supplied with hot water by a hot wire provided therein, the hot wire should continuously be sunk in the washing water, whereby there is a structural limitation in that a separate path should be provided below the tub.

Meanwhile, it is general that a hot-air drying system for drying laundry by heating the air that circulates the tub and an external circulating path is used in the drying process, and the hot wire is arranged on the path, through which the air circulates, to heat the air.

A gas heater or an electric heater, which can heat a hot wire, is required to use the aforementioned hot-air drying system, however, the gas heater has a problem in stability and exhaust gas, and the electric heater has problems in that particles such as scales may be accumulated and too much energy is consumed.

In addition to the aforementioned hot-air drying system, there is a low temperature dehumidification drying system based on a heat pump. The heat pump is reversely uses a cooling cycle of an air conditioner, and therefore requires an evaporator, a condenser, an expansion valve and a compressor in the same manner as the air conditioner. The condenser is used in an indoor system of the air conditioner to cool the indoor air, whereas the heat pump based drying system dries laundry by heating the air in the evaporator. However, the heat pump has problems in that it has a volume greater than that of the other hot-air supply structure, and has a more complicated structure and a higher production cost than the other hot-air supply structure.

Moreover, since the hot-air drying system and the low temperature dehumidification drying system are indirect drying systems based on the air, if laundry is entangled or contains much water, a problem occurs in that a drying time may become longer.

In such various laundry treating apparatuses, the electric heater, the gas heater and the heat pump have their respective advantages and problems as heating means. In this respect, as new heating means that can emphasize the advantages and complement the problems, concepts (Japanese registered patent No. JP2001070689 and Korean registered patent No. KR10-922986) for a laundry treating apparatus using induced heating are provided.

However, such prior arts disclose only basic concepts in which a washing machine performs induced heating, but do not suggest detailed induced heating modules and detailed methods or elements for connection and action relation with basic elements of the laundry treating apparatus, efficiency enhancement and stability.

A coil is wound in an induction heating module provided in the laundry treating apparatus such as a washing machine and a drying machine, and heat may be transferred to a heating target (a drum of the washing machine) by an induced current generated by applying a current to the coil.

In this case, the induction heating module needs a structure for discharging heat generated from the coil, and if the heat is not discharged actively, degradation of the coil may be generated and therefore may be one factor of performance deterioration of the induction heating module.

Since the induction heating module used for a general cooking machine includes a cooling fan for cooling heat generated from the coil, a duct, etc., the above problem may be solved. However, the cooling fan, the duct, etc. used for the general cooking machine cannot be applied to the induction heating module provided in the laundry treating apparatus such as a washing machine and a drying machine due to spatial and positional restrictions.

Therefore, it is required to provide various and detailed technical spirits for efficiency enhancement and safety in the laundry treating apparatus to the induced heating principle is applied.

SUMMARY OF THE INVENTION

Accordingly, the present disclosure is directed to a laundry treating apparatus that substantially obviates one or more problems due to limitations and disadvantages of the related art.

An object of the present disclosure is to provide a laundry treating apparatus that can heat washing water or dry washing targets by directly heating a drum.

Another object of the present disclosure is to provide a laundry treating apparatus that can prevent a temperature of a coil from being excessively increased in an induction heating module.

Still another object of the present disclosure is to provide a laundry treating apparatus that can enhance durability and efficiency of an induction heating module by making sure of a structure for active discharge of heat generated from a coil.

Further still another object of the present disclosure is to provide a laundry treating apparatus in which respective elements of an induction heating module are coupled with each other while making sure of a space for discharging heat generated from a coil.

Further still another object of the present disclosure is to provide a laundry treating apparatus that can reduce a drying time for washing targets by directly heating a drum.

Further still another object of the present disclosure is to provide a laundry treating apparatus that enhances drying efficiency by allowing a center and front and rear of a drum to be uniformly heated.

Further still another object of the present disclosure is to provide a laundry treating apparatus that prevents detachment of components for forming an induction heating module even in case of vibration of a tub by making sure of stable joint of the induction heating module and attenuates noise.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus according to an exemplary embodiment of the present disclosure comprises a cabinet, a drum provided inside the cabinet and formed of a metal material for accommodating a treatment target, and an induction module spaced apart from an outer circumferential surface of the drum at a predetermined interval, inducing and heating the drum, wherein the induction module includes a base housing for accommodating a coil, and a cover housing forming a moving space of heat generated from the coil, jointed to an upper portion of the base housing, the cover housing includes a through portion for discharging the heat by passing through the cover housing up and down, and the cover housing forms a section upwardly inclined toward the through portion to move the heat generated from the coil along the inclined section and discharge the heat to the through portion.

Preferably, the through portion may be provided at the uppermost end of the induction module, and may be formed at a center of the cover housing.

Also, the induction module may further include a permanent magnet housing provided between the base housing and the cover housing and provided with a holder in which a permanent magnet is accommodated.

Preferably, the permanent magnet housing may include a connector for connecting the holder, and the connector may connect an upper portion of the holder.

The connector may be spaced apart from the base housing to form a space for discharge of the heat generated from the coil, and the holder may include an opening portion into which the permanent magnet is inserted, and a barrier extended from a circumference of the opening portion to a lower portion of the opening portion, accommodating the permanent magnet.

The holder may further include supports inwardly protruded from a lower front end of the barrier, supporting the permanent magnet, and the permanent magnet housing may include a through portion communicated with the through portion of the cover housing, and may form a section upwardly inclined toward the through portion of the permanent magnet housing.

Also, the inclined section of the cover housing may be formed to be steeper than the inclined section of the permanent magnet housing, the base housing may form a section upwardly inclined toward the through portion of the permanent magnet housing, and the inclined section of the cover housing may be formed to be steeper than the inclined section of the base housing.

Also, the base housing and the permanent magnet housing may be formed to be bent at the same curvature.

Meanwhile, the laundry treating apparatus according to the exemplary embodiment of the present disclosure further comprises a tub for accommodating the drum, wherein the base housing is fixed to the tub while adjoining an outer circumferential surface of the tub.

Also, a laundry treating apparatus according to the exemplary embodiment of the present disclosure comprises a cabinet, a drum provided inside the cabinet and formed of a metal material for accommodating a treatment target, and an induction module spaced apart from an outer circumferential surface of the drum at a predetermined interval, inducing and heating the drum, wherein the induction module includes a base housing for accommodating a coil, and a cover housing forming a moving space of heat generated from the coil, jointed to an upper portion of the base housing, the cover housing includes a through portion for discharging the heat by passing through the cover housing up and down, and the base housing and the cover housing are formed to be bent, and the heat generated from the coil moves along a bent surface of the cover housing and then is discharged to the through portion.

Preferably, the induction module may further include a permanent magnet housing provided between the base housing and the cover housing and provided with a holder for accommodating a permanent magnet.

Also, the permanent magnet housing and the base housing may be formed to be bent at the same curvature to correspond to the outer circumferential surface of the drum.

Meanwhile, the laundry treating apparatus may further comprise a tub for accommodating the drum, wherein the base housing may be fixed to the tub by being coupled with an outer circumferential surface of the tub.

The respective features of the aforementioned embodiments may complexly be embodied in the other embodiments unless the features are conflict with or exclusive from the other embodiments.

According to the present disclosure, it is possible to heat washing water or dry washing targets by directly heating a drum of the laundry treating apparatus. Also, it is possible to prevent a temperature of a coil from being excessively increased in an induction heating module.

Also, it is possible to enhance durability and efficiency of an induction heating module by making sure of a structure for active discharge of heat generated from a coil of the induction heating module.

Also, it is possible to enhance drying efficiency by allowing a center and front and rear of a drum to be uniformly heated. It is also possible to prevent detachment of components for forming an induction heating module even in case of vibration of a tub by making sure of stable joint of the induction heating module and attenuate noise.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 6A-6D illustrate a top view, side views, and a bottom view of a base housing;

DETAILED DESCRIPTION OF THE INVENTION

Hereinafter, embodiments will be described in detail with reference to the accompanying drawings.

However, spirits of the present disclosure are not limited to embodiments which are suggested, and it should be understood that other embodiments that may be regarded by the person with ordinary skill in the art to which the present disclosure pertains as embodiments within the same or equivalent range of the present disclosure belong to the scope of the present disclosure.

Also, since the elements described hereinafter are intended to describe one embodiment of the present disclosure, it should be understood that the corresponding elements are not intended to restrict the scope of the present disclosure.

Meanwhile, terms expressed in this specification are the same as general meaning understood by the person with ordinary skill in the art to which the present disclosure pertains, but should be interpreted as meaning defined in this specification if the terms are different from meaning defined in this specification.

In the elements described hereinafter, the expression that an element is "connected" with another element or an element is "provided" in another element may mean that the element may directly be connected or coupled with or provided in another element, a third element may be interposed between the corresponding elements.

A preferred embodiment of a laundry treating apparatus according to the present disclosure will be described. First of all, a whole configuration of the laundry treating apparatus 1 will be described.

The laundry treating apparatus of this embodiment may include a cabinet 1000 forming an external appearance, a tub 2000 provided inside the cabinet, and a drum 3000 rotatably provided inside the tub 2000, accommodating laundry, drying targets or refresh targets. The shown embodiment relates to a washing machine, in which washing water is stored in the tub 2000 and therefore washing may be performed through the drum provided inside the tub 2000.

If the laundry treating apparatus of this embodiment is applied to a drying machine, drying targets may be accommodated in the drum, and in this case, the tub may be omitted.

Figure 1:
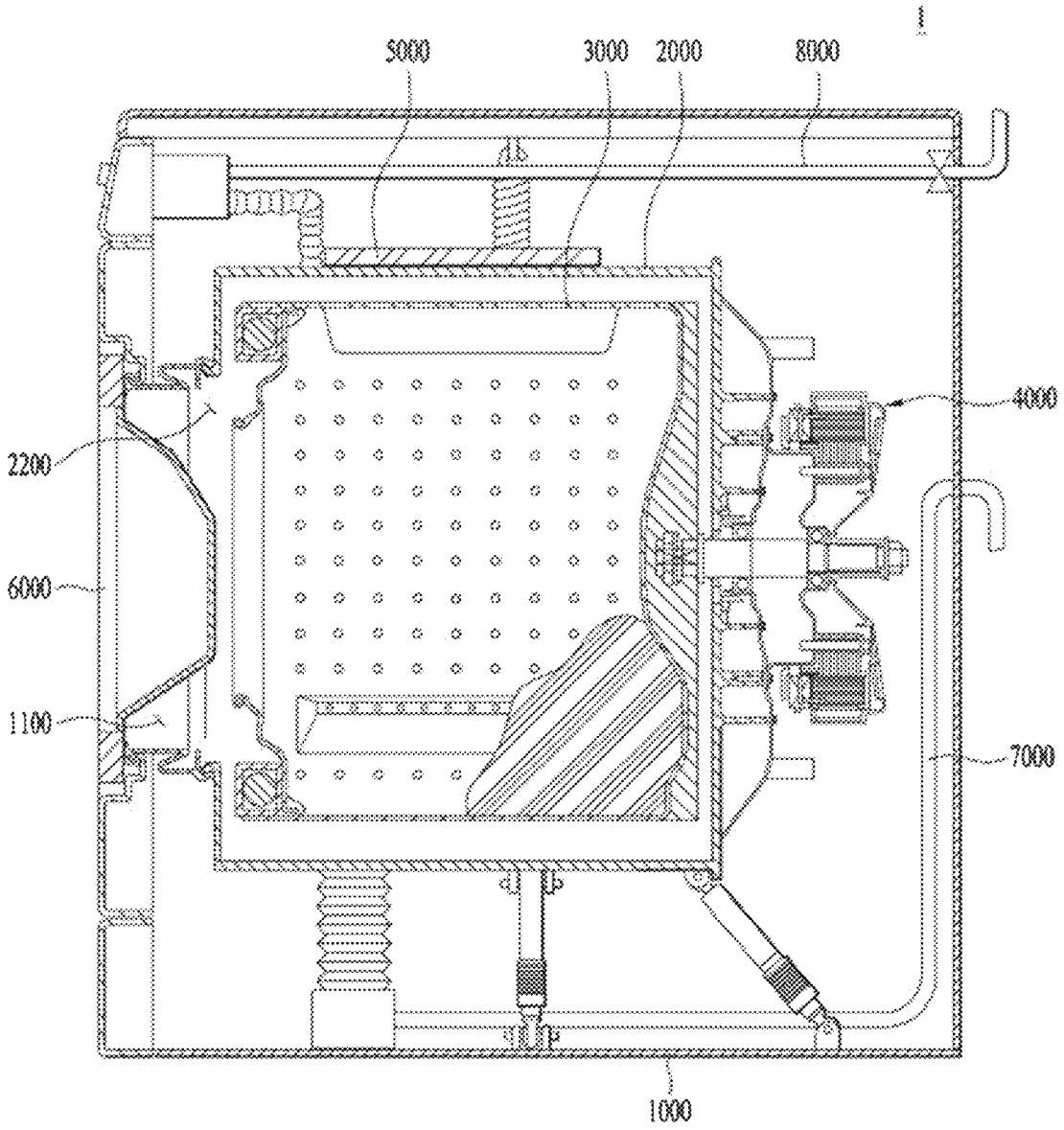
FIG. 1 illustrates a whole configuration of a laundry treating apparatus.

FIG. 1 illustrates a whole configuration of a laundry treating apparatus. The laundry treating apparatus 1 may include a cabinet 1000 forming an external appearance of the laundry treating apparatus 1, provided with an inlet 1100 through which laundry may be inserted, a tub 2000 located inside the cabinet 1000 and provided with an opening 2200 communicated with the inlet 1100, a drum 3000 provided inside the tub 200 and formed of a metal material, accommodating laundry therein, a door 6000 hinge-coupled with the cabinet 1000 to enable insertion and ejection of laundry, and an induction module 5000 for heating the drum 3000 by means of a magnetic field.

The tub 2000 may be located inside the cabinet 1000 by a spring provided on an upper surface inside the cabinet 1000 and a damper 1200 provided on a lower surface inside the cabinet 1000.

Also, the tub 2000 may be fixed to the lower surface inside the cabinet 1000 by a rear support (not shown) bent and extended from the rear of the tub 2000 to the lower portion of the tub and a suspension (not shown) connected with the rear support and provided with a spring and a damper. In this case, the rear of the tub 2000 may be provided to be inclined at a predetermined angle inside the cabinet 1000.

The drum 3000 may rotatably be provided inside the tub 2000, and at this time, a driver 4000 for rotating the drum 300 may be provided at the rear of the tub 2000. If the drum 3000 moves inside the tub 2000 while being rotated, vibration is delivered to the tub 2000. Therefore, structures provided in the tub 2000 are also vibrated, and a detailed description for problems and solutions according to vibration will be described later.

Meanwhile, the tub 2000 may be provided with a water supply pipe 8000 if washing water is supplied thereto. The water supply pipe 8000 may be provided to be communicated with the tub 2000 by passing through a detergent box D provided in the cabinet 1000. This is to allow a detergent used for washing to be supplied to the tub 2000 together with washing water when the washing water is supplied to the tub 2000.

Also, the tub 2000 may further be provided with a drainage pipe 7000 for discharging washing water stored therein to the outside. If drainage starts, the washing water is drained from the lower portion of the tub and then discharged to the outside of the laundry treating apparatus 1 through the drainage pipe 7000 by a drainage pump (not shown).

In case of the laundry treating apparatus 1 having a washing function, since it is required to perform washing by enhancing a temperature of the washing water within the range that permanent damage (for example, shrinkage, distortion, loss of waterproof function, etc.) is not caused, depending on laundry, a heating structure for enhancing the temperature of the washing water is required.

Both the laundry treating apparatus 1 having a washing function and a drying function and the laundry treating apparatus 1 having only a drying function need a heating structure for drying of laundry.

Therefore, the laundry treating apparatus includes an induction module 5000 that may be used to heat washing water or for drying.

Figure 2A:
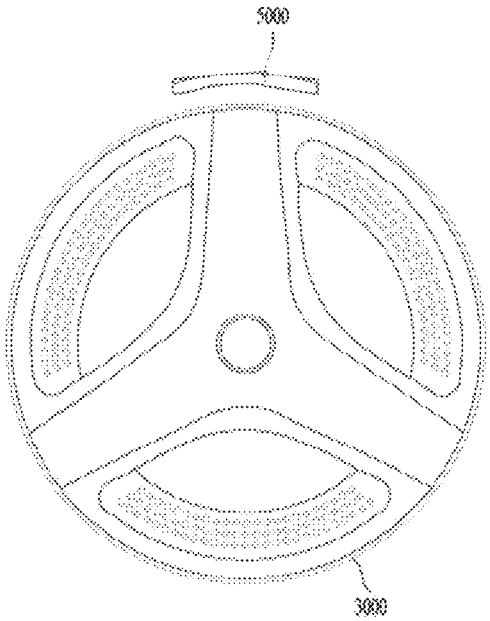
FIGS. 2A and 2B illustrate a front view and a side view of an induction module and a drum.
Figure 2B:
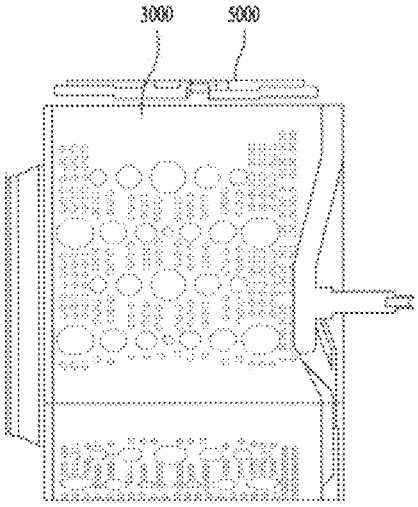

The principle of heating the drum 3000 using the induction module 5000 will be described with reference to FIGS. 2A and 2B.

Figure 3A:
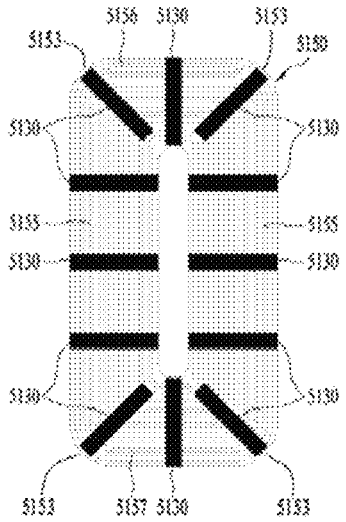
FIGS. 3A and 3B are upper views illustrating an arrangement structure of a coil and a permanent magnet.
Figure 3B:
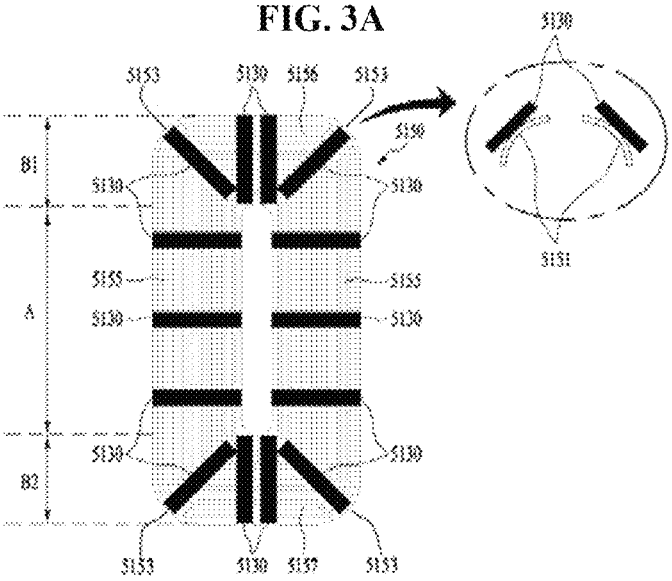

The induction module 5000 is mounted onto an outer circumferential surface of the tub 2000, and serves to heat a circumferential surface of the drum 3000 through a magnetic field generated as a current is applied to a coil 5150 in which a wire 5151 is wound (refer to FIGS. 3A and 3B for shapes of the wire and the coil).

However, as described above, since the tub may be omitted in case of a drying machine for which washing based on water is not performed, the induction module of the drying machine may substitute for the tub as a frame or bracket for holding the induction module is provided. The frame or the bracket may be an element for fixing the induction module to the drum at a predetermined interval like the tub.

The wire 5151 may be formed of a core wire and a coating covering the core wire. The core wire may be a single core wire. A plurality of core wires may be entangled to form one core wire. Therefore, a thickness or core diameter of the wire 5151 may be determined by the core wire and a coating thickness.

A method for heating the drum 3000 through the coil 5150 will be described. An alternating current of which phase is changed flows to the coil 5150 arranged at an outside of the circumferential surface of the drum 3000, and the coil 5150 forms a radial alternating current magnetic field in accordance with Ampere's circuit law.

This alternating current magnetic field is concentrated on the drum 3000 made of a conductor having high magnetic permeability. In this case, magnetic permeability means a level of a medium magnetized for a given magnetic field. At this time, an eddy current is formed in the drum 3000 in accordance with Faraday's law of induction. This eddy current flows along the drum 3000 made of a conductor and then is switched to Joule's heat by resistance of the drum 3000, whereby an inner wall of the drum 3000 is directly heated.

If the inner wall of the drum 3000 is directly heated, an air temperature inside the drum 3000 and a temperature of laundry which is in contact with the inner wall of the drum 3000 increase together. Therefore, since laundry is capable of being directly heated, the corresponding drying machine enables faster drying than the drying machine, which is an indirect heating system based on the hot-air drying system or the low temperature dehumidification drying method.

The laundry treating apparatus 1 having a washing function may heat washing water even without a separate hot wire and a separate path, and the washing water continues to be in contact with the inner and outer walls of the drum 3000. Therefore, it is possible to heat the washing water more quickly than the heating method using a separate path and a separate hot wire, which are formed below the tub.

A preferred embodiment of a shape of the coil will be described with reference to FIGS. 3A to 4B.

Figure 4A:
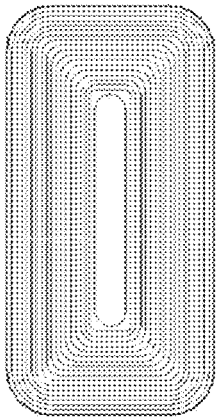
FIG. 4A illustrates coils having the same curvature radius in a curved line.
Figure 4B:
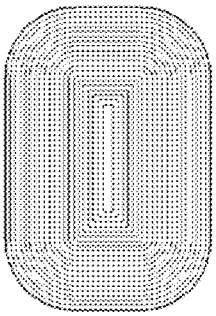
FIG. 4B illustrates inner and outer coils having different curvature radiuses in a curved line.

FIGS. 3A and 3B illustrate an upper surface of a coil 5150 in which the wire 5151 is wound at an outside of a circumferential surface of the tub 2000. FIGS. 4A and 4B illustrate various types of coil shapes.

The coil 5150 may be provided in all shapes, which can form a coil on the outer circumferential surface of the tub 2000 by means of winding of the wire 5151, such as a concentric circle, an oval, and a track shape. However, a heating level of the drum 3000 may be varied depending on the wound shape.

This is because that a magnetic field delivered toward a central direction of the drum 3000 and a magnetic field delivered to the front and the rear of the drum 3000 are remarkably different from each other in their amount if a curvature radius of a curved portion is formed differently in the inner coil and the outer coil like a shape of the coil disclosed in FIG. 4B.

In other words, since an area of the coil located near the front and the rear of the drum 3000 is narrow, the amount of a magnetic field delivered to the front of the circumferential surface of the drum 3000 may be relatively small. Since an area of the coil located at the center A of the drum is wide, the amount of a magnetic field delivered to the center of the circumferential surface of the drum 3000 may be relatively large. Therefore, it is difficult to uniformly heat the drum 3000.

Therefore, the wire 5151 may be wound in the coil 5150 such that the coil 5150 may include linear portions 5155, 5156 and 5157 and a curved portion 5153 as shown in FIG. 4A, and it is preferable that a curvature radius of the wire 5151 that forms the curved portion 5153 is formed equally for the inner coil and the outer coil.

It is noted that a corner area in the coil of FIG. 4A and a corner area in the coil of FIG. 4B are remarkably different from each other.

The relation between the linear portions 5155, 5156 and 5157 and the curved portion 5153 will be described in more detail. The linear portions 5155, 5156 and 5157 may include horizontal linear portions 5156 and 5157 including a front linear portion 5156 provided at the front of the outer circumferential surface of the tub 2000 and a rear linear portion 5157 provided at the rear of the outer circumferential surface of the tub 2000, and a vertical linear portion 5155 formed vertically for the horizontal linear portions 5156 and 5157. The curved portion 5153 is formed at a point where the horizontal portions 5156 5157 meet the vertical linear portion 5155.

That is, the coil may be formed of the front linear portion 5156, the rear linear portion 5157, vertical linear portions 5155 at both sides, and four curved portions 5153 formed among the linear portions 5155, 5156 and 5157, having the same curvature radius.

In accordance with the aforementioned configuration, coil both end portions B1 and B2 including a coil front end portion adjacent to the front of the tub 2000 and a coil rear end portion adjacent to the rear of the tub, and a horizontal width of the coil center portion A located between the coil both end portions B1 and B2 may be formed uniformly.

As a result, the amount of a magnetic field radiated toward the front and the rear of the circumferential surface of the drum 3000 from the coil both end portions B1 and B2 becomes similar to the amount of a magnetic field radiated toward the center of the circumferential surface of the drum 3000 from the coil center portion A.

Therefore, the center and the front and rear of the circumferential surface of the drum 300 may be heated uniformly.

A temperature distribution of the drum according to the shape of the coil will be described with reference to FIGS. 5A to 5C.

Figure 5A:
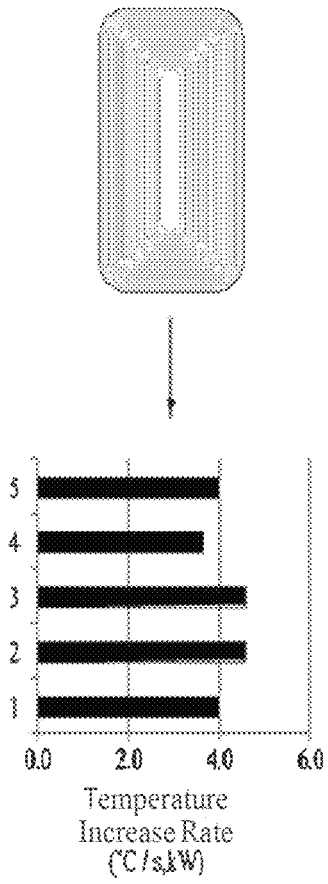
FIGS. 5A-5C are graphs illustrating temperature increase rates per position of a drum according to shapes of a base housing provided with a coil.
Figure 5B:
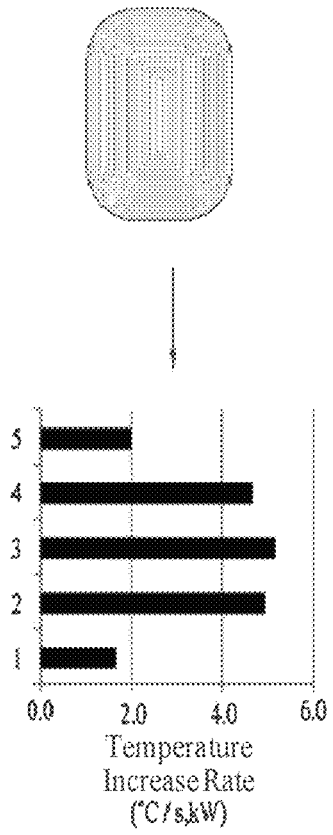
Figure 5C:
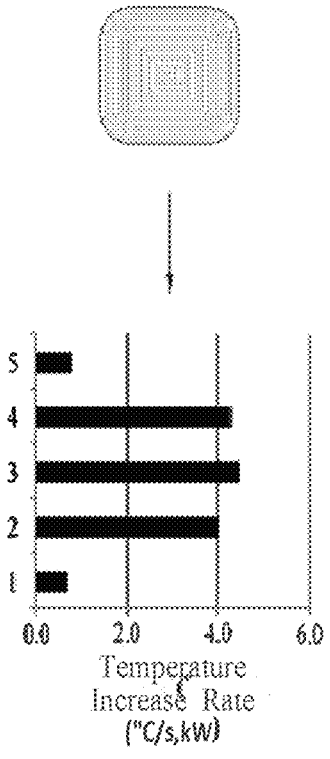

The coil 5150 having different vertical lengths and heating distribution of the circumferential surface of the drum 3000 according to the vertical width of the coil 5150 are shown in FIGS. 5A to 5C.

In the graph, a vertical axis displays each position of the drum, wherein '1' indicates the rear of the outer circumferential surface of the drum, '5' indicates the front of the outer circumferential surface of the drum 3000, and '2' to '5' indicate an interval between the rear of the outer circumferential surface and the front of the outer circumferential surface. Also, a horizontal axis indicates a temperature increase rate of the drum 3000.

Hereinafter, the vertical width of the coil 5150 and the temperature increase rate of the drum 3000 are relatively compared with each other based on each coil 5150 disclosed in FIGS. 5A to 5C. FIG. 5A illustrates that the drum is heated using the coil having the widest vertical width, FIG. 5B illustrates that the drum is heated using the coil having a vertical width of a middle width, and FIG. 5C illustrates that the drum is heated using the coil having the narrowest vertical width.

The coil of FIG. 5A indicates a uniform temperature increase rate of the front and rear and the center of the drum 3000 as compared with the other coil, the coil of FIG. 5C has a remarkable difference in a temperature increase rate between the front and rear and the center of the drum 3000, and the coil of FIG. 5B indicates a difference in a relatively more temperature increase rate.

That is, it is noted that the front and rear and the center of the drum 3000 may be heated relatively uniformly as the vertical width of the coil 5150 becomes longer under the assumption that the respectively coils 5150 have the same horizontal width. That is, it is preferable that a long shaft of the coil of an oval or track shape is formed in a front and rear direction of the tub.

This case may be interpreted that the coil 5150 is provided on the outer circumferential surface of the tub 2000. In this case, it is noted that the circumferential surface of the drum 3000 provided in the tub 2000 is heated more uniformly as both end portions B1 and B2 of the coil 5150 are provided to be close to the front of the tub 2000.

Meanwhile, if the outmost wire of the horizontal linear portions 5156 and 5157 is provided to be extended to the front and rear of the tub 2000, the drum 3000 may be heated more uniformly. However, in this case, the magnetic field is too extended to the front and rear, whereby the other elements of the laundry treating apparatus, such as the driver 4000 and the door 6000 may be heated and therefore a problem occurs in that the laundry treating apparatus 1 is damaged.

Also, in case of the laundry treating apparatus 1 in which the rear of the tub 2000 is provided to be inclined inside the cabinet 1000, a problem may occur in that the induction module 5000 and the cabinet 1000 are damaged due to interference between the front upper corner of the induction module 5000 and the upper surface of the cabinet 1 when the tub 2000 is vibrated up and down. If the height of the cabinet 1000 becomes higher in order to solve the problem, there is a limitation in that a compact laundry treating apparatus cannot be embodied.

Therefore, the outmost wire of the front linear portion 5156 is spaced apart from the front of the tub 2000 at a predetermined interval, and the outmost wire of the rear linear portion 5157 is spaced from the rear of the tub 2000 at a predetermined interval, wherein the predetermined interval ranges from 10 mm to 20 mm.

The aforementioned element may unnecessarily heat the other element in addition to the drum 3000 or prevent interference between the induction module 5000 and the upper surface inside the cabinet 1000 from occurring and at the same time uniformly heat the outer circumferential surface of the drum 3000.

Moreover, it is preferable that the outmost wire of the vertical linear portion 5155 of the coil 5150 has a length longer than that of the outmost wire of the horizontal linear portion 5156 and 5157.

This case prevents the magnetic field from being radiated in a surrounding direction of the drum 3000 in a too wide range so as not to heat the other elements except the drum 3000, and may make sure of an arrangement space of a spring or the other element that may be provided on the outer circumferential surface of the tub.

At this time, a surface where the coil 5150 is formed by winding of the wire 5151 may be provided as a curved surface corresponding to the circumferential surface of the drum 3000. In this case, magnetic flux density of the magnetic field toward the drum 3000 may further be enhanced.

Moreover, if the induction module 5000 is operated, it is preferable that the drum 3000 is rotated to uniformly heat the circumferential surface of the drum 3000.

Meanwhile, the magnetic field formed by the coil 5150 is radiated toward the drum 3000 made of a conductor having high magnetic permeability, whereas the magnetic field is partially radiated in an opposite direction or front and rear of the drum 3000 and toward both sides of the coil 5150.

Therefore, it is required to concentrate the magnetic field generated by the coil 5150 toward the drum 3000. To this end, the induction module 5000 may further include a permanent magnet 5130.

The embodiment of the permanent magnet and arrangement of the permanent magnet will be described with reference to FIGS. 3A and 3B.

The permanent magnet 5130 serves as a shielding member to prevent the other element near the drum 3000 from being heated, and serves to enhance heating efficiency by concentrating the magnetic field generated in the coil 5150 toward the drum 3000.

As shown in FIGS. 3A and 3B, the permanent magnet 5130 may be provided as a bar magnet, and is preferably arranged on the coil 5150 vertically to a length direction of the coil 5150. This is to cover the inner coil and the outer coil at the same time.

The permanent magnet 5130 may be provided with a plurality of bar magnets having the same size, wherein the plurality of permanent magnets 5130 may be arranged to be spaced apart from one another along a length direction of the coil 5150.

In the case that the permanent magnet 5130 is arranged at only a specific position, the amount of the magnetic field radiated toward the drum 3000 is varied depending on each portion of the circumferential surface of the drum 3000, whereby it is difficult to perform uniform heating. Therefore, in order to uniformly induce the magnetic field generated in the coil 5150 toward the drum 5150, the plurality of coils 5150 are preferably arranged to be spaced apart from one another along the circumference of the coils 5150.

Moreover, it is preferable that the permanent magnets 5130 are concentrated on the portion of the coil 5150, which is adjacent to the front and rear of the tub 2000, if there are the same number of permanent magnets 5130.

In detail, as shown in FIG. 3B, the coil 5150 may be categorized into the coil both end portions B1 and B2 including the coil front end portion B1 adjacent to the front of the tub 2000 and the coil rear end portion B2 adjacent to the rear of the tub 2000 and the coil center portion B1 located between the coil front end portion B1 and the coil rear end portion B2 and formed to be wider than the coil front end portion B1 and the coil rear end portion B2, and the permanent magnets 5130 of the coil center portion A, which are equal to or more than those of the coil front end portion B1 or the coil rear end portion B2, may be arranged.

In the coil center portion A, the magnetic field is radiated to be extended to both sides of the coil 5150. In this case, since the drum 3000 is formed to be wider than the width of the coil center portion A, uniform heating may be made in a width direction of the drum 3000 even though more permanent magnets are not arranged.

On the other hand, in the coil front end portion B1 and the coil rear end portion B2, the magnet is radiated to both sides of the coil 5150. In the coil front end portion B1, the magnetic field is radiated to the front of the drum 3000. In the coil rear end portion B2, the magnetic field is radiated to the rear of the drum 3000.

Also, in the coil front end portion B1 and the coil rear end portion B2, density of the coil is relatively low. That is, density of the coil may be lowered at both end portions by a round shape of a corner portion. This is because that the coil cannot be formed in the corner portion theoretically vertically.

Therefore, if the same number of permanent magnets 5130 are arranged at each of the coil front end portion B1, the coil rear end portion B2 and the coil center portion A, non-uniform heating may occur in a length direction of the drum 3000.

Therefore, if the same number of permanent magnets 5130 are arranged, it is more preferable that the permanent magnets 5130 are concentrated on both end portions B1 and B2 rather than the coil center portion A. That is, the front and rear portions of the drum may uniformly be heated. In the embodiment shown in FIG. 3B rather than the embodiment shown in FIG. 3A, the drum may be heated more uniformly, whereby efficiency may be enhanced.

In other words, magnetic flux density of the coil both end portions B1 and B2 may be enhanced through concentration of the permanent magnets, whereby the drum 30 is uniformly heated in a length direction.

In detail, under the same condition, efficiency in the embodiment shown in FIG. 3B may be more enhanced than that in the embodiment shown in FIG. 3A. Also, on the assumption of the same number of permanent magnets, it is preferable that a permanent magnet 76 located at the center portion A is located at both end portions B1 and B2, in view of efficiency. Therefore, if total magnetic flux density is determined through the permanent magnet, it is preferable that magnetic flux density at both end portions is greater than that at the center portion.

The embodiment directed to a winding shape of the aforementioned coil 5150 and the embodiment directed to arrangement of the permanent magnet 5130 may be embodied in one laundry treating apparatus 1 without being conflicted with each other. In this case, the drum 3000 may be heated more uniformly than the laundry treating apparatus 1 in which each embodiment is embodied.

Meanwhile, if the drum 3000 is rotated during washing or drying, vibration is delivered to the tub 2000, and structures provided in the tub 2000 are also vibrated, whereby noise of the laundry treating apparatus 1 may become serious or durability may be weakened.

Also, if the tub 2000 is vibrated, the coil 5150 provided in the tub 2000 is also vibrated, whereby the coil 5150 may be detached or noise may be generated. Therefore, in order to solve this problem, it is preferable that the coil 5150 is provided with robustness in the tub 2000. To this end, it is preferable that the coil 5150 is provided in the tub 2000 using the induction module 5000.

The induction module 5000 will be described with reference to FIG. 7.

The induction module 5000 serves as a clamp member for fixing the coil 5150 to the outer circumferential surface of the tub 2000, and may further include a base housing 5100 provided on the outer circumferential surface of the tub 2000 so as not to detach the coil 5150 even though the tub 2000 is vibrated.

Figure 7:
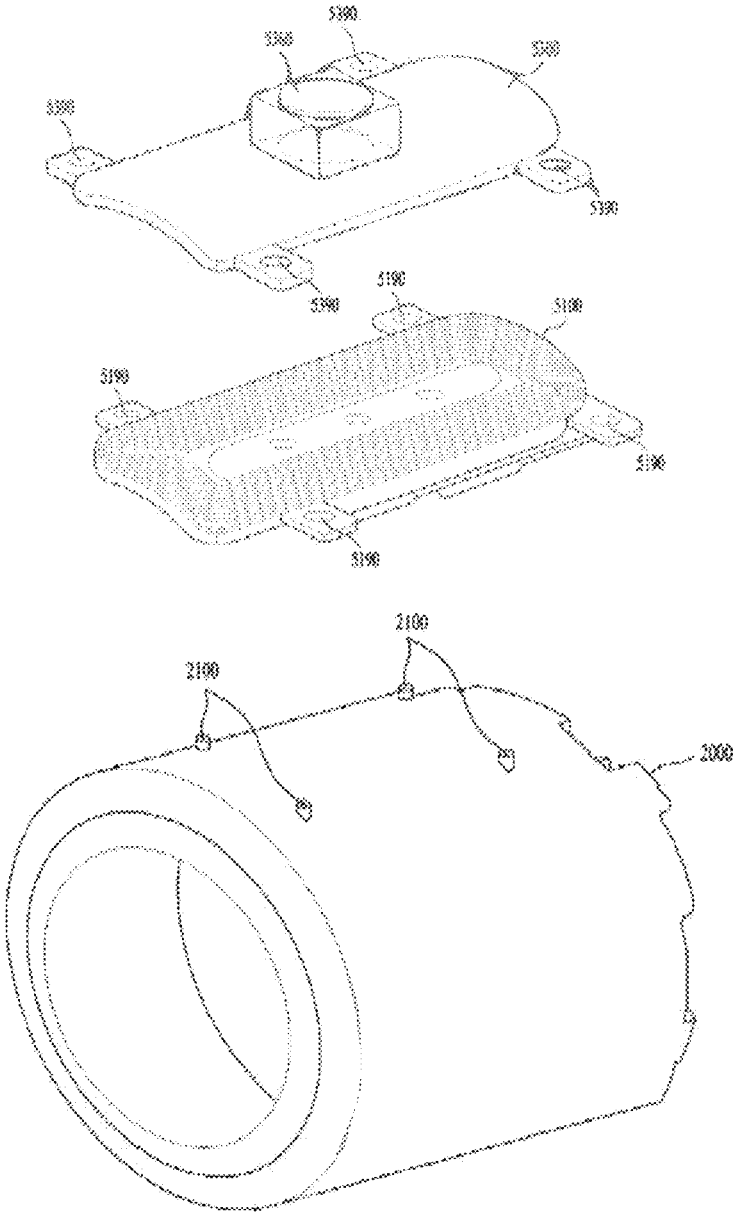
FIG. 7 is a perspective view illustrating a coupling relation among a tub, a base housing and a cover.

FIG. 7 illustrates that the base housing 5100 is provided in the tub 2000. FIG. 6A illustrates an upper surface of the base housing 510, and FIG. 6D illustrates a lower surface of the base housing 5100.

First of all, the base housing 5100 will be described with reference to FIG. 6.

As shown in FIG. 6B and FIG. 6C, the base housing 5100 may form a coil slot 5120 narrower than a core diameter of the wire 5151 such that the wire 5151 of the coil 5150 is forcibly fitted into the coil slot 5120, and the width of the coil slot 5120 may be formed in the range of 93% to 97% of the core diameter of the wire 5151.

If the wire 5151 is forcibly fitted into the coil slot 5120, the wire 5151 is fixed into the coil slot 5120 even though the tub 2000 is vibrated, whereby the coil 5150 does not move.

Therefore, the coil 5150 is not detached from the coil slot 5120, and movement is restricted, whereby noise, which may occur due to a gap, may be avoided.

Moreover, the coil slot 5120 may be formed by a plurality of fixed ribs 5121 upwardly protruded from the base housing 5100, wherein each fixed rib may be provided with a height greater than the core diameter of the coil 5150.

The fixed rib 5121 should be provided with a height greater than the core diameter of the coil 5150 such that an inner wall of the fixed rib 5121 and both sides of the coil 5150 may be supported by being sufficiently in contact with each other. This feature is related to a melting process of the upper end of the fixed rib 5121, which will be described later.

Since the fixed rib 5121 and the wire 5151 adjacent to the fixed rib 5121 are detachably fixed to each other by the aforementioned feature, shirt-circuit may be avoided. Since it is not required to coat a separate insulating film on the wire 5151 or a thickness of the insulating film may be minimized, the production cost may be reduced.

Also, the upper end of the fixed rib 5121 may be melted after the wire 5151 is inserted into the fixed thereto and therefore provided to cover the upper portion of the coil 5150. That is, the upper end of the fixed rib 5121 may be subjected to a melting process.

At this time, it is preferable that the fixed rib 5121 is provided with a height of 1 to 1.5 times of the core diameter of the wire 5151 to cover the upper portion of the coil 5150.

In detail, referring to FIG. 6C, if the wire is forcibly fitted into the fixed rib 5121, the upper surface of the fixed rib 5121 may be pressurized and then melted. Then, as shown in FIG. 6C, the melted fixed rib 5121 may partially be spread toward both sides to cover the upper portion of the wire 5151. At this time, it is preferable that the respective fixed ribs 5121 adjacent to each other by interposing the wire 5151 therebetween may be melted to fully shield the upper portion of the wire 5151 in the coil slot 5120 or may be melted to form an interval narrower than the core diameter of the wire at the upper portion of the wire 5151.

As another embodiment, the coil slot 5120 may be melted to cover only the wire 5151 at one side not the wire 5151 at both sides. In this case, all the fixed ribs 5121 should be melted to cover only the wire 5151 inwardly provided among the wires 5151 adjacent thereto, or should be melted to cover only the wire 5151 outwardly provided.

In addition to the case that the coil 5150 is forcibly fitted into the coil slot 5120, the reason why that the upper end of the fixed rib 5121 is melted may physically shield a path through which the wire 5151 may be detached, may prevent noise caused by vibration of the tub 2000 from occurring by preventing the wire 5151 from moving, and may improve durability by allowing a gap between components to be removed.

The coil slot 5120 may further include a slot base 5122, on which the coil 5150 is arranged, below a portion between the fixed ribs 5121.

The slot base 5122 has a lower surface shielded as shown in FIG. 6C, and serves to pressurize and fix the coil 5150 together with the fixed rib 5121 which is melted.

However, the slot base 5122 may partially be opened. In this case, an open structure provided in the slot base 5122 may be referred to as a through hole or through portion 5170.

In the aforementioned description, the coil 5150 is provided on an upper surface of the base housing 5100, however, the fixed rib 5151 may be protruded below the base housing 5100 such that the coil 5150 may be provided on a lower surface of the base housing 5100. In this case, a space formed by the fixed ribs 5121 which are melted serves as the through portion even though a separate through portion is not provided in the slot base 5122.

FIG. 6D is a view illustrating the lower surface of the base housing 5100. As shown, a through portion 5170 that passes through the upper surface may be provided on the lower surface of the base housing 5100. The through portion 5170 has an open structure to allow the coil 5150 to face the outer circumferential surface of the tub 2000, and may be formed along a winding shape of the wire 5151.

If the through portion is formed along a winding shape of the wire 5151, the magnetic field may actively be radiated from the wire 5151 to the drum 3000 to enhance heating efficiency. Since the air may move along an open surface, it is advantageous that the coil 5150 which is overheated may quickly be cooled.

Also, referring to FIG. 6D, a base support bar 5160 formed on the lower surface of the base housing 5100 to cross the through portion is disclosed, and the base housing 5100 may further include the base support bar 5160.

The base support bar 5160 may be provided in a radiation shape around fixed points 5165 at both sides of the center portion A of the base housing 5100 to enhance a joint force between the outer circumferential surface of the tub 2000 and the base housing 5100.

If base joints 5190 provided at both sides of the base housing 5100 are fixed to tub joints 2100 provided on the outer circumferential surface of the tub, the outer circumferential surface of the tub 2000 is pressurized by the base support bar 5160. Therefore, the outer circumferential surface of the tub 2000 may be supported more strongly than the case that the lower surface of the base housing 5100 is fully in contact with the outer circumferential surface of the tub 2000 (see FIG. 7). As a result, the base housing 5100 may be neither easily moved nor detached from the outer circumferential surface of the tub 2000 even though the tub 2000 is vibrated.

Moreover, in order to improve the joint force between the base housing 5100 and the outer circumferential surface of the tub 2000, the base housing 5100 may form a curved surface corresponding to the outer circumferential surface of the tub 2000.

On the upper surface of the base housing 5100 in which the wire 5151 is wound, the curved portions of the fixed ribs 5121 may be formed with the same curvature radius to correspond to the feature of the aforementioned coil curved portions 5153 which are formed with the same curvature radius (see FIGS. 3A and 3B).

Meanwhile, as shown in FIG. 7, the induction module 5000 may further include a cover 5300 coupled with the base housing 5100 to cover the coil slot 5120.

The cover 5300 is provided to be coupled with the upper surface of the base housing 5300 as shown in FIG. 7, and serves to prevent detachment of the coil 5150 and the permanent magnet 5130 from occurring.

In detail, a lower surface of the cover 5300 may be formed to be adhered to the upper end of the coil slot 5120 of the base housing 5100. Therefore, the cover 5300 may be prevented from moving.

The cover 5300 will be described in detail with reference to FIGS. 8A and 8B.

Figure 8A:
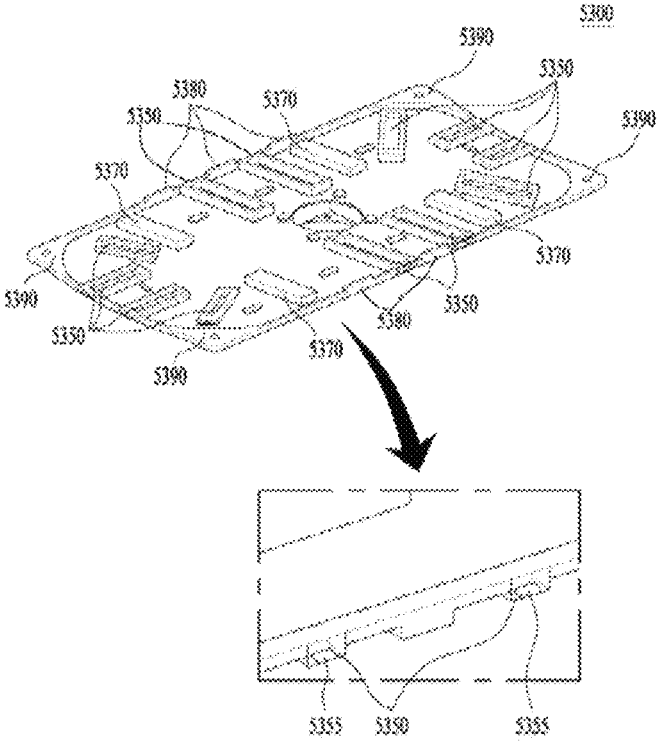
FIG. 8A illustrates a rear view and a side view of a cover.
Figure 8B:
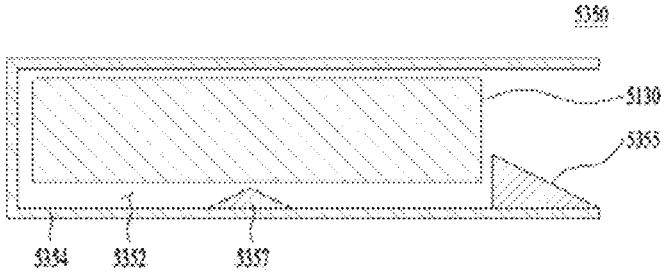
FIG. 8B illustrates a section of a permanent magnet holder.

Referring to FIG. 8A, a plurality of reinforcing ribs 5370 downwardly protruded may be provided on the lower surface of the cover 5300, and may be provided such that the reinforcing ribs 5370 and the upper end of the coil slot 5120 may be adhered to each other.

If the lower surface of the reinforcing rib 5370 is adhered to the coil slot 5120, more pressure may be applied to a narrow area than the case that the lower surface of the cover 5300 is fully adhered to the upper end of the coil slot 5120.

Therefore, since the cover 5300 may be fixed to the outer side of the tub 2000 more stably, noise caused by a gap or detachment of components does not occur.

The reinforcing rib 5370 may be provided with a plural number along a length direction of the coil 5150. Also, the reinforcing rib 5370 may be provided vertically to the length direction of the coil 5150. Therefore, it is possible to stably fix the coil even without fully pressuring the coil.

In this case, a gap space is required between the cover 5300 and the coil 5150. This is because that the air should preferably move for radiation of heat. Therefore, the gap space is partially filled with the reinforcing rib 5370. Therefore, a moving space of the air is formed and at the same time the coil may be fixed.

Meanwhile, the reinforcing rib 5370 is preferably formed in a single body with the cover 5300. Therefore, the cover 5300 is coupled with the base housing 5100 and at the same time the reinforcing rib 5370 pressurizes the coil 5150. Therefore, a means or step for pressurizing the coil 5150 separately is not required.

Also, the permanent magnet 5130 may be interposed between the base housing 5100 and the cover 5300, and the cover 5300 may include a permanent magnet holder 5350 into which the permanent magnet 5130 may be inserted Therefore, if the permanent magnet 5130 is fixed to the cover 5300, the cover 5300 may be coupled to the base housing 5100 and therefore the permanent magnet 5150 may be fixed to the upper portion of the coil 5150.

The permanent magnet 5130 is preferably arranged at a specific position of the upper surface of the coil 5150 to efficiently concentrate the magnetic field toward the drum 3000. Therefore, if the permanent magnet 5130 moves in accordance with vibration of the tub 2000, noise and deterioration of heating efficiency may occur.

Therefore, the permanent magnet 5130 may be fixed to the initial position between the base housing 5100 and the cover 5300 by the permanent magnet holder 5350, whereby heating efficiency may be prevented from being deteriorated.

In more detail, the permanent magnet holder 5350 may be formed of both sidewalls downwardly protruded from the lower surface of the cover 5300 and provided to face each other, and may include a lower opening portion 5352 where the lower surface of the permanent magnet 5130 provided in the permanent magnet holder 5350 may face one surface of the coil 5150.

In this case, horizontal movement of the permanent magnet 5130 may be restricted by the both sidewalls, and the lower opening portion 5352 may allow the permanent magnet 5130 to be more adjacent to the upper surface of the coil 5150.

As the permanent magnet 5130 is provided to be more adjacent to the coil 5150, the magnetic field is guided toward the drum 3000 more intensively, whereby the drum 3000 may be heated stably and uniformly.

Also, the permanent magnet holder 5130 may further include an inner sidewall 5354 downwardly protruded from the lower surface of the cover 5300 at one end of the both sidewalls, and a latch 5355 provided with an open surface formed on a surface facing the inner wall and formed such that the permanent magnet 5130 is not detached from the cover 5300.

Since forward and backward movement of the permanent magnet 5130 may be restricted by the inner sidewall 5354 and the latch 5355, the drum 3000 may be heated stably and uniformly as described above, whereas the permanent magnet 5130 may radiate heat through the open surface if its temperature is increased by the overheated coil 5150.

At this time, the base housing may further include a permanent magnet pressurizer 5357 upwardly protruded from the space where the lower opening portion 5352 is formed, pressurizing the lower surface of the permanent magnet 5130. The permanent magnet pressurizer 5357 may be provided as a protrusion made of a plat spring or rubber material.

If vibration is delivered to the permanent magnet 5130 in accordance with vibration of the tub 2000, noise may be generated in the permanent magnet 5130 by a gap that may be formed between the coil slot 5120 at the lower portion and the permanent magnet holder 5350.

Therefore, the permanent magnet pressurizer 5357 may prevent noise from being generated by buffering vibration, and may prevent the permanent magnet 5130 and the permanent magnet holder 5350 from being damaged by vibration by allowing the gap not to be generated.

Moreover, the lower end of the permanent magnet holder 5350 may be provided to be adhered to the upper end of the coil slot 5120 to improve a joint force and stably heat the drum 3000.

In this case, since the lower surface of the permanent magnet 5130 may be provided to be more adjacent to the coil 5150 as described above, the drum 3000 may be heated more uniformly, and the lower surface of the permanent magnet 5130 may serve as the reinforcing rib 5370 to enhance adhesion between the cover 5300 and the base housing 5100.

Additionally, if the base housing 5100 is formed in a curved surface corresponding to the outer circumferential surface of the tub 2000, the cover 5300 may be formed in a curved surface having the same curvature as that of the base housing 5100.

As another embodiment, the permanent magnet holder 5350 may be provided in the base housing 5100.

The base housing 5100 may be formed such that the permanent magnet 5350 may be provided at the upper portion of the fixed rib 5121. At this time, the permanent magnet pressurizer 5357 may be provided on the lower surface of the cover 5300.

A method for coupling the cover 5300 and the base housing 5100 to the tub 2000 will be described with reference to FIG. 7.

A joint type of the tub 2000, the base housing 5100 and the cover 5300 is disclosed in FIG. 7. Referring to FIG. 7, the tub 2000 discloses the tub joints 2100, the base housing 5100 discloses the base joints 5190, and the cover 5300 discloses cover joints 5390.

The tub joint 2100 includes a tub joint hole, the base joint 5190 includes a base joint hole, and the cover joint 5390 includes a cover joint hole, wherein the joint holes may be provided with diameters of the same length, and may be provided such that the tub 2000, the base housing 5100 and the cover 5300 may simultaneously be jointed by one screw.

Therefore, simple assembly may be performed during the manufacturing process, and the cost may be reduced.

In addition, the tub joint 2100, the base joint 5190 and the cover joint 5390 may be provided to avoid joint points at both sides of the coil 5150 to make sure of a joint space if both end portions B1 and B2 of the coil are provided to be adjacent to the front and rear of the tub 2000.

Moreover, as shown in FIG. 8, the cover 5300 may further cover ribs 5380 downwardly protruded at both corners. This is to allow the cover 5300 to be easily provided in its position of the base housing 5100 and prevent horizontal movement of the cover 5300 from occurring.

Meanwhile, as shown in FIG. 7, a fan holder 5360 may be formed in the cover 72. The fan holder 5360 may be formed at the center of the cover 5300.

The air may enter the inside of the cover 5300, that is, the inside of the induction module through the fan holder. Since a space is formed between the cover 5300 and the base housing 5100 in the induction module, a moving space of the air is formed. A through portion is formed in the base housing. Therefore, the air may cool the coil 5150 in the inner space, and may be discharged to the outside of the induction module through the through portion of the base housing.

In this specification, although the induction module 5000 is provided on the outer circumferential surface of the tub 2000, the induction module 5000 may be provided on the inner circumferential surface of the tub 2000 or the same circumferential surface may be formed together with the outer wall of the tub 2000.

In this case, it is preferable that the induction module 5000 is located to be close to the outer circumferential surface of the drum 3000 if possible. That is, this is because that the magnetic field generated by the induction module 5000 is remarkably reduced as the distance with the coil is increased.

As shown in FIG. 8, in the aforementioned embodiment, since a plurality of permanent magnet holders 5350 are provided in the cover 5300, the shape of the cover 5300 is complicated. Therefore, a shape of injection molding for manufacturing the cover 5300 is also complicated. Therefore, the cost of injection molding may be increased, and quality of injection molding may be deteriorated.

Also, in the aforementioned embodiment, the permanent magnetic holder 5350 is provided on the bottom of the cover 5300, and therefore the permanent magnet 5130 is inserted at the side of the permanent magnet holder 5350. Therefore, it is not easy to arrange the permanent magnet 5130 in the permanent magnet holder 5350, and if the permanent magnet 5130 is damaged, it is not easy to replace the damaged permanent magnet with a new one.

Meanwhile, the cover 5300 may be manufactured by insert injection of the permanent magnet 5130. However, in this case, if the number of permanent magnets 5130 is increased, manufacturing yield is deteriorated. For example, if the number of permanent magnets 5130 is increased, proper heat transfer is not performed in a portion an interval between the permanent magnets is narrow, whereby sufficient injection may not be performed. In order to solve this problem, if insert injection is performed at high pressure, the permanent magnet 5130 may be damaged in the middle of insert injection.

This embodiment suggests an improved induction module.

Figure 9:
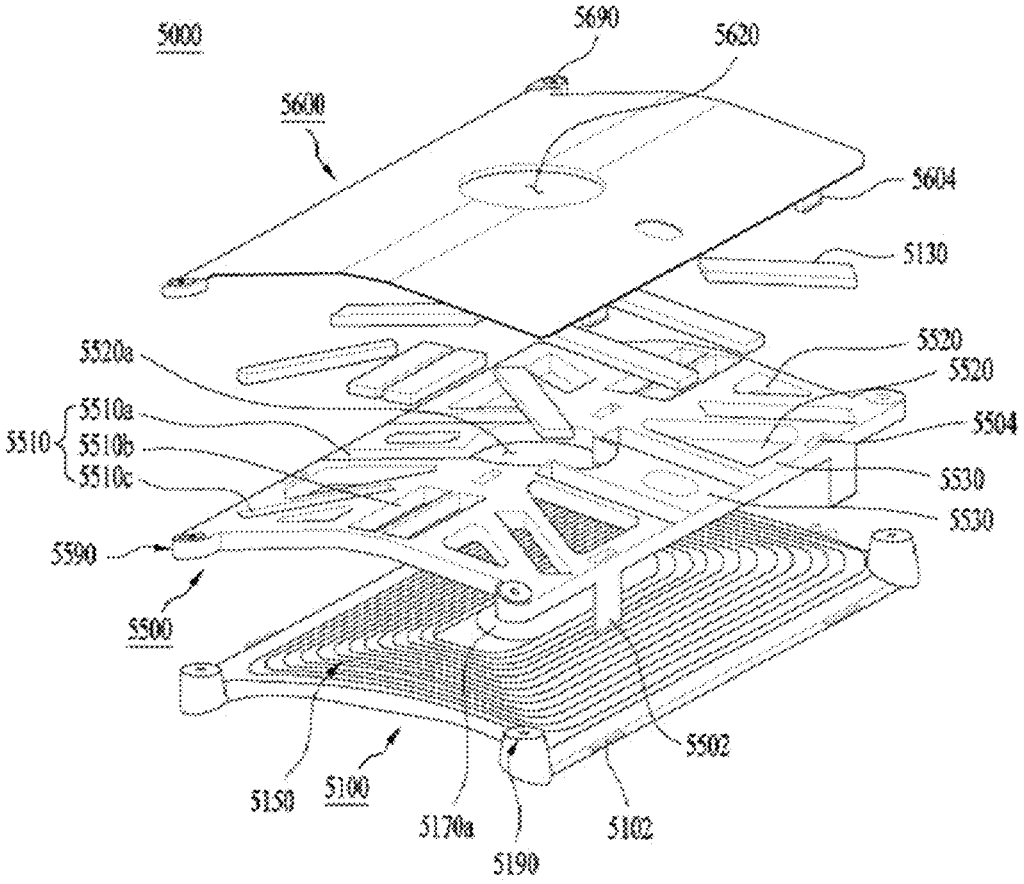
FIG. 9 is an exploded perspective view illustrating another embodiment of an induction module.
Figure 10:
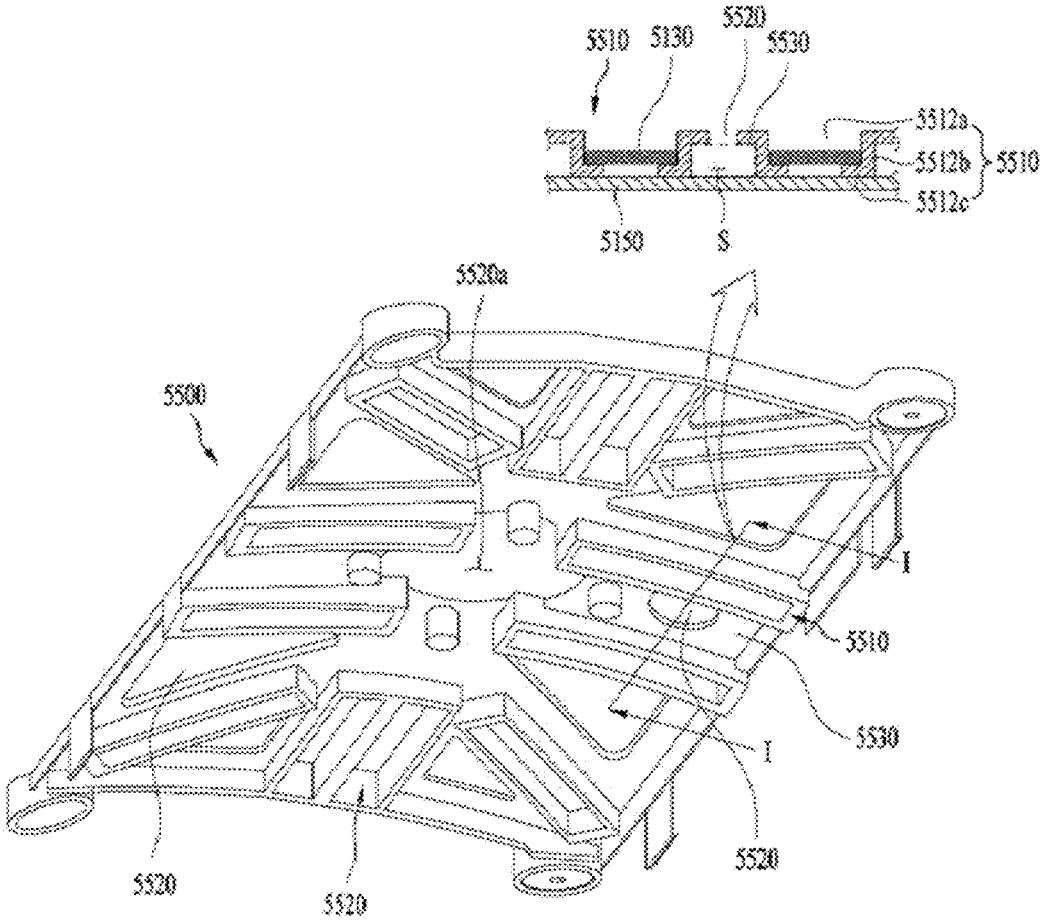
FIG. 10 is a bottom perspective view illustrating a permanent magnet housing.

Another embodiment of the induction module according to the present disclosure will be described with reference to FIGS. 9 and 10.

First of all, a whole structure of the induction module 5000 will be described.

The induction module 5000 includes a base housing 5100 in which the coil 5150 is accommodated, a permanent magnet housing 5500 in which the permanent magnet 5130 is accommodated, and a cover housing 5600 for covering the permanent magnet housing 5500. That is, in this embodiment, the cover of the aforementioned embodiment is divided into the permanent magnet housing 5500 and the cover housing 5600. Also, the permanent magnet 5130 may be inserted into the permanent magnet housing 5500 from up to down, and the cover housing 5600 is jointed to allow the permanent magnet 5130 not to be detached from the permanent magnet housing 5500.

Hereinafter, each element will be described in detail.

First of all, the base housing 5100 will be described.

The base housing 5100 has a square shape, preferably a rectangular shape, and the coil 5150 is accommodated in an upper portion of the base housing 5100. It is preferable that a through portion 5170*a* is provided in the center of the base housing 5100.

The joint 5190 is provided at the corner portion of the base housing 5100, and it is preferable that the joint 5190 is outwardly protruded from the corner portion. Also, a ring 5102 coupled with a hook 5502 of the permanent magnet housing 5500 is provided at the rim of the base housing 5100. Preferably, two rings 5102 are provided at both sides of a long side portion of the base housing 5100. Therefore, a total of four rings 5102 are provided. (A detailed coupling structure will be described later.)

Since a structure of the other portion of the base housing 5100 may substantially be similar to the base housing of the aforementioned embodiment, its description will be omitted.

Next, the permanent magnet housing 5500 will be described.

It is preferable that the shape of the permanent magnet housing 5500 has a shape corresponding to the base housing 5100. For example, it is preferable that the permanent magnet housing 5500 has a rectangular shape.

A holder 5510 in which the permanent magnet 5130 is arranged is provided in the permanent magnet housing 5500. Also, since it is preferable that the permanent magnet housing 5500 is provided by one component, a connector 5530 for a plurality of holders 5510 with one another is preferably provided. The connector 5530 has a structure which is opened up and down, instead of a structure which is blocked up and down, whereby heat generated from the coil 5150 may move. Therefore, the connector 5530 is preferably provided with a through portion 5520 opened up and down.

The holder 5510 may be provided in a plural number, and is preferably provided in a radial direction from the center of the base housing 5100 to the rim of the base housing 5100. Since the holder 5510 is a portion where the permanent magnet 5130 is mounted, it is preferable that the holder 5510 has a shape corresponding to the permanent magnet 5130, that is, a rectangular shape having a narrow width.

In detail, the holder 5510 may include a long side holder 5510*a*, a short side holder 5510*b*, and a corner holder 5510*c*. The long side holder 5510*a* may be provided in such a manner that two long side holders are respectively provided at both sides near the center of the long side portion of the base housing 5100. The short side holder 5510*b* may be provided in such a manner that two short side holders are respectively provided at both sides near the center of the short side portion of the base housing 5100. The corner holder 5510*c* may be provided in such a manner that four corner holders are respectively provided in a corner direction at the center of the long side portion of the base housing 5100.

The through portion 5520 may be provided to up and down open the portion where the holder 5510 is not provided, for example, the space between the holder 5510 and its adjacent holder 5510. That is, the through portion 5520 is preferably provided in a shape corresponding to the shape of the space between the holder 5510 and its adjacent holder 5510. Also, since the through portion 5520 may serve to discharge heat generated from the coil 5150, it is preferable that the through portion 5520 has a wide area if possible within the range that maintains strength of the permanent magnet housing 5500.

In detail, it is preferable that the holder 5510 in which the permanent magnet 5130 is provided has a thickness of 2.0t, and the connector 5530 for connecting the plurality of holders 5510 with one another has a thickness of 1.5t. Since the holder 5510 is a portion in which the permanent magnet 5130 is mounted, the holder 5510 may be formed to be thicker than the connector 5530 to maintain rigidity. The connector 5530 may be formed to be thinner than the holder 5510 to maintain a certain distance from the base housing 5100 for supporting the permanent magnet 5130 and at the same time accommodating the coil 5150.

If heat of high temperature is applied to the permanent magnet 5130, atoms moves chaotically, whereby the permanent magnet 5130 loses magnetism. This could weaken durability of the induction module 5000.

Therefore, a difference in thickness between the holder 5510 and the connector 5530 may prevent the temperature of the permanent magnet 5130 from being increased by heat formed on the lower surface of the permanent magnet housing 500 and generated from the coil 5150.

Meanwhile, the joint 5590 is provided at the corner portion of the permanent magnet housing 5500. Preferably, the joint 5590 is outwardly protruded from the corner portion.

The hook 5502 downwardly extended is provided at the rim of the permanent magnet housing 5500, and the hook 5502 is inserted into the ring 5102 of the base housing 5100.

Also, a groove 5504 is provided at a predetermined position inside the permanent magnet housing 5500, and is coupled with a hook 5604 of the cover housing 5600. (A detailed coupling structure will be described later.)

Next, the cover housing 5600 will be described.

It is preferable that the cover housing 5600 has a shape corresponding to the permanent magnet housing 5500. For example, it is preferable that the cover housing 5600 has a rectangular shape. The through portion 5620 may be provided at the center of the cover housing 5600, and a fan (not shown) may be mounted in the through portion 5620. The joint 5690 is provided at the corner portion of the cover housing 5600, and is preferably has a long hole. The hook 5604 coupled with the groove 5504 of the permanent magnet housing 5500 is provided at the lower portion of the cover housing 5600. (A detailed coupling structure will be described later.)

The permanent magnet housing 5500 will be described in more detail with reference to FIGS. 9 and 10.

Preferably, the holder 5510 for mounting the permanent magnet 5130 has an opened upper portion so that the permanent magnet 5130 may be inserted thereinto from up to down. In this case, it is easy to insert the permanent magnet 5130 to the permanent magnet holder 5510. It is preferable that the permanent magnet 5130 mounted in the permanent magnet holder 5510 is prevented from being detached by the cover housing 5600 coupled to the upper portion.

The holder 5510 will be described in detail.

As described above, it is preferable that the permanent magnet 5130 is inserted into the holder 5510 from up to down. Therefore, it is preferable that the holder 5510 is provided with an opening portion 5512*a* at the upper portion and therefore the permanent magnet 5130 is inserted into the opening portion 5512*a*. Also, the holder 5510 should have a space to which the permanent magnet 5130 is fixed. Therefore, the holder 5510 has a barrier 5512*a* extended to the lower portion of the opening portion 5512*a*, and the permanent magnet 5130 is fixedly supported by the barrier 5512*b*. Preferably, a sectional shape of the barrier 5512*b* corresponds to the shape of the permanent magnet 5130. Also, a support portion 5512*c* for supporting the permanent magnet 5130 so as not to be detached is provided at the front end below the barrier 5512*b*. Preferably, the support portion 5512*c* is inwardly protruded from the front end below the barrier 5512*b*.

Meanwhile, as described above, the permanent magnet housing 5500 has a connector 5530 for connecting the holders 5510. The connector 5530 is located between the holders 5510 to connect the holders 5510. The connector 5530 may connect a predetermined position of the barrier 5510*b* of the holder 5510, for example, the upper portion or the lower portion.

However, it is preferable that the connector 5530 connects the upper portion of the holder 5510 to efficiently discharge heat generated from the coil 5150. This is because that the space S between the holder 5510 and its adjacent holder 5510 becomes a convention current space for discharging heat of the coil 5150. That is, heat generated from the coil 5150 may be discharged to the upper side of the permanent magnet housing 5500 through the through portion 5520 and the convention current space S.

Figure 11:
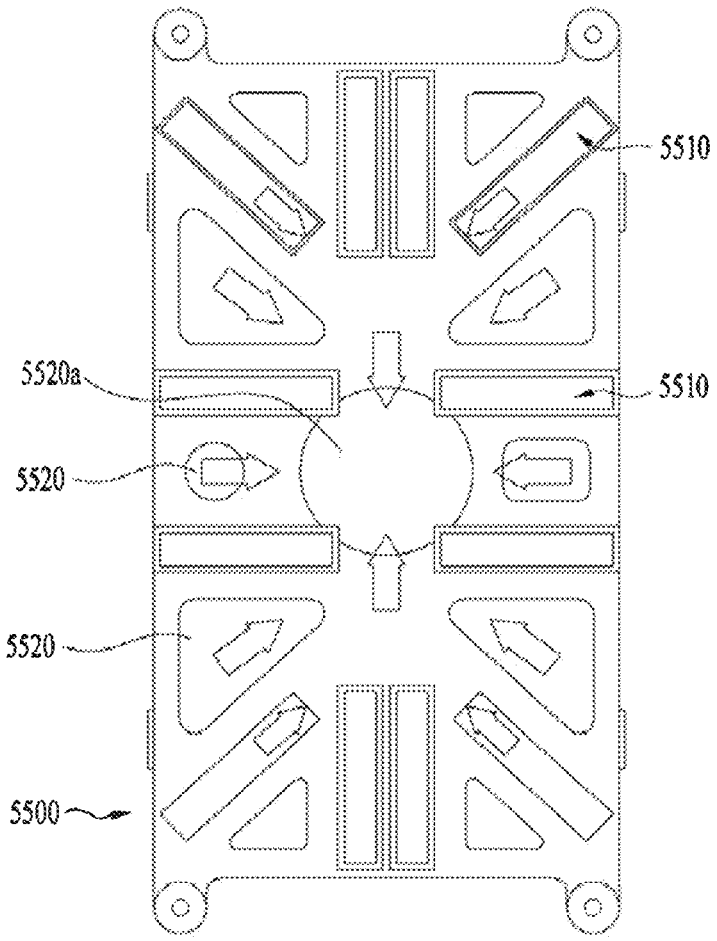
FIG. 11 is a plane view illustrating a permanent magnet housing of FIG. 10.

As shown in FIG. 11, heat that has passed through each through portion 5520 of the permanent magnet housing 5500 is collected in the through portion 5520*a* at the center. Heat collected in the through portion 5520*a* at the center of the permanent magnet housing 5500 is discharged to the outside through the through portion 5620 at the center of the cover housing 5600. If a fan (not shown) is provided in the through portion 5620 at the center of the cover housing 5600, heat radiation effect may be more improved.

Meanwhile, it is preferable that heat generated from the coil 5150 is induced to a natural convection current using the shape of the induction module and then discharged to the outside of the induction module.

The cover housing 5600 forms a predetermined space to move heat generated from the coil, and is jointed to the upper portion of the base housing 5100.

In detail, the cover housing 5600 includes a through portion 5620 that passes through the cover housing 5600 to discharge the heat, and forms a section upwardly inclined toward the through portion 5620 to allow the heat generated from the coil to move along the inclined section and then to be discharged to the through portion 5620.

That is, a space where the heat may move may be formed by the base housing 5100 and the cover housing 5600, and the heat generated from the coil accommodated in the base housing 5100 may form an ascending air current, move along an inner surface inclined toward the upper portion of the cover housing 5600 and be discharged to the outside of the induction module 5000 through the through portion 5620.

In order to induce discharge of the heat generated from the coil by means a natural convection current, the through portion 5620 may preferably be provided at the uppermost end of the induction module 5000, and may be formed at a center portion of the cover housing 5600.

The uppermost end may mean a place where a height difference between the cover housing 5600 and the base housing 5100 is the greatest, and the center portion of the cover housing 5600 may be defined differently depending on a shape of the cover housing 5600.

In this embodiment, the cover housing 5600 may be provided in a rectangular shape that forms two long sides and two short sides, the through portion 5620 may be formed at the center of the cover housing 5600, and the cover housing 5600 may form a section upwardly inclined from the two long sides toward the through portion 5620.

According to another embodiment of the present disclosure, the cover housing 5620 may be provided in a shape parallel with the two long sides and bent based on a virtual line crossing a center point of the cover housing 5600, wherein the bent level of the cover housing 5600 may correspond to an outer circumferential shape of the drum.

Therefore, the base housing 5100 and the cover housing 5600 may be bent to correspond to the outer circumferential surface of the drum, and the heat generated from the coil may move along the bent surface of the cover housing 5600 and then be discharged to the through portion 5620.

In detail, the permanent magnet housing 5500 provided between the base housing 5100 and the cover housing 5600 may also be bent to correspond to the outer circumferential surface of the drum, whereby the base housing 5100, the permanent magnet housing 5500 and the cover housing 5600 are formed to be bent with the same curvature, wherein the curvature is preferably the same as a curvature formed by the outer circumferential surface of the drum.

Figure 12:
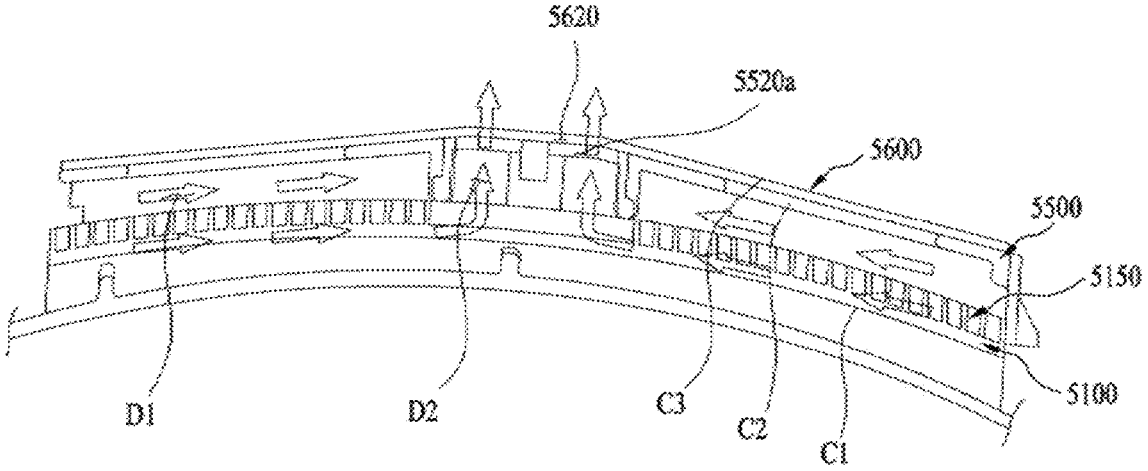
FIG. 12 is a longitudinal sectional view illustrating an induction module of FIG. 9.

A structure for discharging heat generated from the coil 5150 to the outside by a natural convention current will be described with reference to FIG. 12.

It is preferable that the section C1 of the base housing 5100 is a curved line. This is because that the drum is heated by the coil 5150. Therefore, in order to uniformly heat the drum, it is preferable that the base housing 5100 in which the coil 5150 is accommodated substantially has the same curved section as a curvature of the drum and/or the tub. On the other hand, it is preferable that the permanent magnet housing 5500 and the cover housing 5600 have sections C2 and C3 upwardly inclined toward the center portion, and it is more preferable that the long side portion is inclined (see FIG. 9).

This is because that a space D2 of a center portion becomes greater than a space D1 of an outer portion if the permanent magnet housing 5500 and the cover housing 5600 are upwardly inclined. In accordance with characteristic of this shape, heat generated from the coil 5150 is guided to easily move to the natural convection current.

Therefore, heat generated from the coil 5150 easily and upwardly moves along the inclined section, and is finally discharged to the outside through the through portion 5620 at the center of the cover housing 5600. If the fan is provided in the through portion 5620 at the center of the cover housing 5600, heat may be discharged to the outside more effectively.

The connector 5530 of the permanent magnet housing 5500 may connect the upper portion of the holder 5510. This feature in the shape of the connector 5530 may make sure of a moving space of the heat generated from the coil by providing the permanent magnet housing 5500 between the cover housing 5600 and the base housing 5100 and forming a space between the base housing 5100 and the permanent magnet housing 5500. Therefore, the upper portion of the connector 5530 may be in contact with the inner surface of the cover housing 5600, and the lower portion of the connector 5530 may be spaced apart from the base housing 5100 at a predetermined interval to make sure of the moving space of the heat.

However, this embodiment is not limited to the shape of the connector 5530. The connector 5530 may connect the lower portion of the holder 5510. In this structure, the moving space of the heat may be formed between the permanent magnet housing 5500 and the cover housing 5600.

The through portion of the permanent magnet housing 5500 may be provided to be connected with the through portion of the cover housing 5600, wherein the through portions respectively mean center through portions 5520*a* and 5620 formed at the center of the permanent magnet housing 5500 and the cover housing 5600.

Also, as the permanent magnet housing 5500 forms the section upwardly inclined toward the through portion 5520*a*, the heat may move to the through portion 5520 along the inclined section and then be discharged to the outside of the induction module 5000 through the through portion 5620 of the cover housing communicated with the through portion 5520*a*.

Next, a joint structure of the base housing 5100, the permanent magnet housing 5500 and the cover housing 5600 will be described.

The induction module 5000 uses the induced heating principle. Therefore, a magnetism such as a screw is used, and the joint is located to be adjacent to the coil 5150. Therefore, abnormal heating may occur in the joint using the screw, etc. If abnormal heating occurs, strength near the screw may partially be weakened, whereby the screw may get loose. Therefore, it is preferable to perform another joint in addition to the joint using the magnetism such as the screw.

Figure 13:
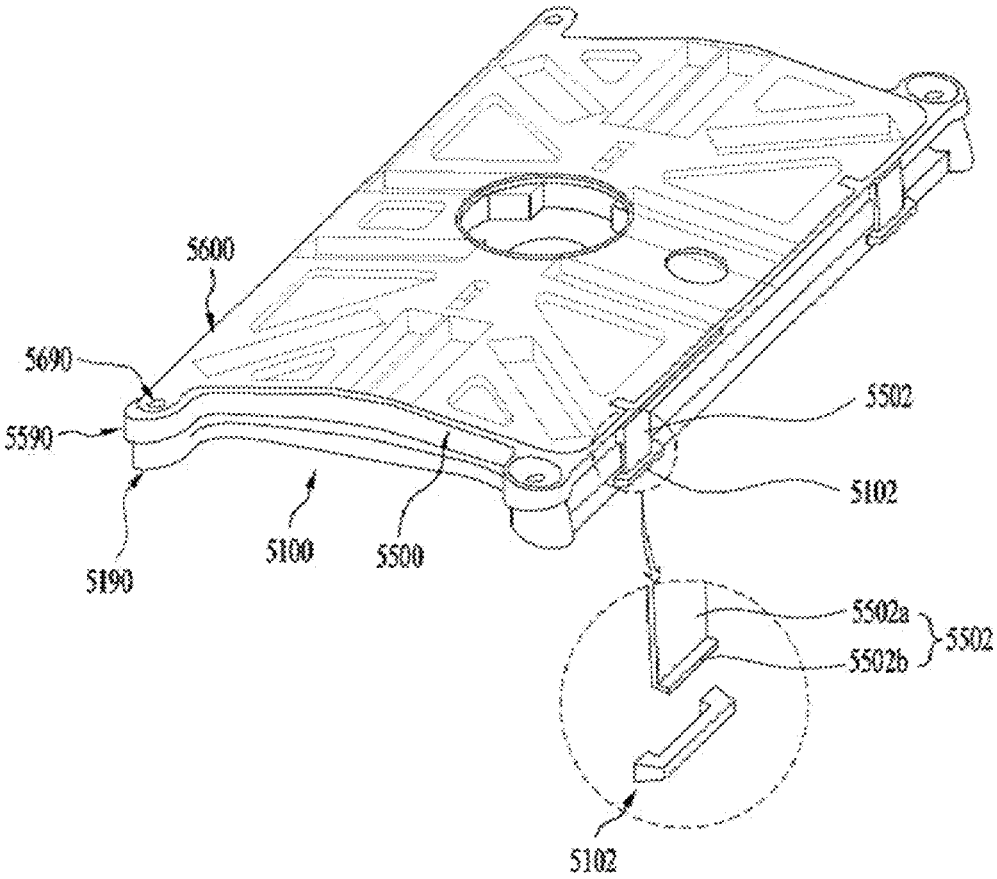
FIG. 13 is a coupled perspective view illustrating a base housing and a permanent magnet housing of FIG. 9.

First of all, the joint structure of the base housing 5100 and the permanent magnet housing 5500 will be described with reference to FIG. 13.

As described above, the hook 5502 is provided in the permanent magnet housing 5500, and the ring 5102 is provided in the base housing 5100. It is preferable that two hooks 5502 are provided at both sides of the long side portion of the base housing 5100, and the rings 5102 are preferably provided to correspond to the hooks 5502. The hook 5502 and the ring 5102 are preferably made of a non-magnetic material.

Preferably, the hook 5502 includes a vertical portion 5502*a* extended vertically, and a horizontal portion 5502*b* outwardly extended from a front end of the vertical portion 5502*a*.

The hook 5502 and the ring 5102 are jointed to each other by pushing the hook 5502 of the permanent magnet housing 5500 toward the ring 5102 of the base housing 5100 from up to down.

As described above, the base housing 5100 and the permanent magnet housing 5500 are jointed to each other using the hook 5502 and the ring 5102. Therefore, even though the joint force of the joints 5190 and 5590 jointed by the screw is weakened, the joint of the base housing 5100 and the permanent magnet housing 5500 may be maintained by the hook 5502 and the ring 5102.

Figure 14:
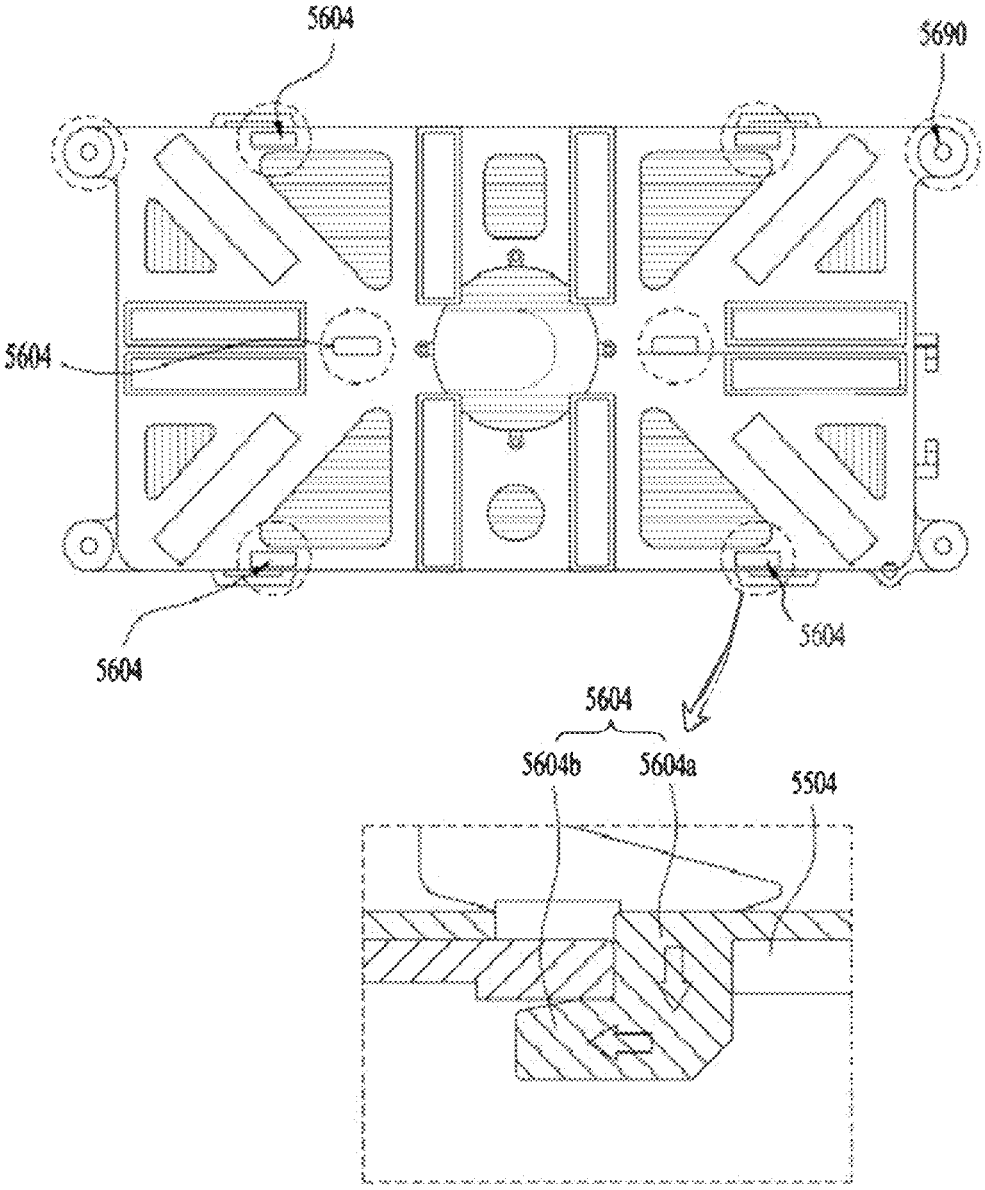
FIG. 14 is a plane view illustrating coupling of a cover and a permanent magnet of FIG. 9.

The joint structure of the cover housing 5600 and the permanent magnet housing 5500 will be described with reference to FIG. 14.

The cover housing 5600 is provided with the hook 5604, and the permanent magnet housing 5500 is provided with the groove 5504. It is preferable that the hook 5604 is provided to be extended to a bottom direction of the cover housing 5600. It is also preferable that two hooks 5502 are respectively provided at both sides near the long side portion of the cover housing 5600 and two hooks 5502 are provided at the center portion. The permanent magnet housing 5500 is preferably provided with the groove 5504 corresponding to the hook 5502.

Preferably, the hook 5604 includes a vertical portion 5604*a* extended vertically, and a horizontal portion 5604*b* horizontally extended from a front end of the vertical portion 5604*a*. It is preferable that the horizontal portion 5604*b* is extended toward a long side portion of the cover housing 5600. It is preferable that a plurality of hooks 5604 are provided in the same direction.

The hook 5604 of the cover housing 5600 is inserted into the groove 5504 of the permanent magnet housing 5500 and then jointed to the groove 5504. At this time, the hook 5604 and the groove 5504 are jointed to each other using inclination by pushing the cover housing 5600 from the upper side of the permanent magnet housing 5500 toward a horizontal direction. It is preferable that tolerance generated in an inclined surface after maximum assembly is absorbed by a long hole of the joint 5690. This is because that a damage is likely to occur if there is no tolerance during joint using a great screw.

As described above, the cover housing 5600 and the permanent magnet housing 5500 are jointed to each other using the hook 5604 and the groove 5504. Therefore, even though the joint force of the joint 5690 is weakened, the joint of the cover housing 5600 and the permanent magnet housing 5500 may be maintained by the hook 5604 and the groove 5504.

It is preferable that the base housing 5100, the permanent magnet housing 5500 and the cover housing 5600 are jointed using the screw by the joints 5190, 5590 and 5690. Also, it is preferable that the holes of the joints 5190, 5590 and 5690 are long holes.

Meanwhile, the tub is vibrated during operation of the laundry treating apparatus, particularly washing or dehydrating, whereby the induction module is also vibrated. At this time, if the permanent magnet provided in the induction module is vibrated, noise may be generated or the permanent magnet may be damaged if vibration is serious. Therefore, it is preferable that the permanent magnet 5130 is stably fixed to the permanent magnet holder 5510 of the permanent magnet housing 5500.

The structure of stably fixing the permanent magnet 5130 to the permanent magnet holder 5510 will be described with reference to FIGS. 15 and 16.

A clamp 5650 for fixing the permanent magnet 5130 is provided at a predetermined position of the cover housing 5600, particularly at a portion where the permanent magnet 5130 is located.

Figure 15:
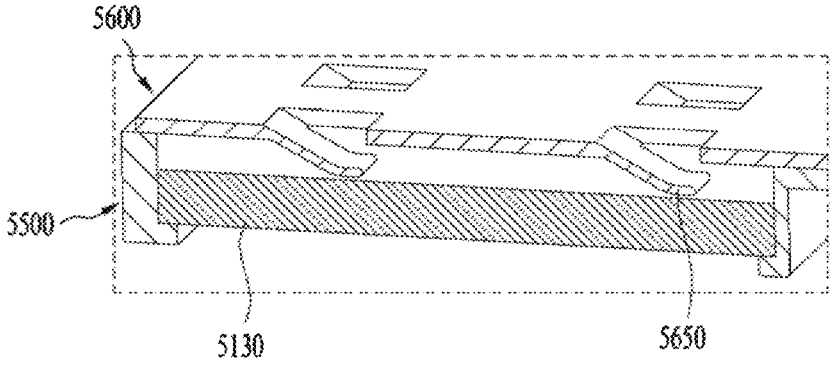
FIGS. 15 and 16 are cut perspective views illustrating a modified example of a cover housing of FIG. 9.

As shown in FIG. 15, it is preferable that the clamp 5650 is formed by partially cutting the cover housing 5600 and allowing the cut portion to be downwardly located. The cover housing 5600 is capable of being generally made of a plastic material. If the clamp 5650 is made of a thin plate shape, the clamp 5650 may serve as a plate spring. In this case, since the clamp 5650 has elasticity, the clamp 5650 may absorb impact such as vibration. Also, even though there is assembly tolerance of each portion, the clamp 5650 may absorb such tolerance in accordance with its elasticity.

Figure 16:
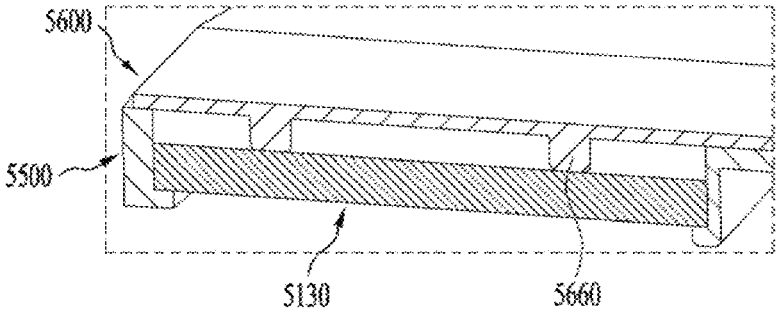

As shown in FIG. 16, the clamp 5650 may be formed by vertically protruding the cover housing 5600 from the bottom to the lower portion. In this case, the clamp 5650 has less elasticity. Therefore, in this case, it is preferable that the clamp 5650 fixes the permanent magnet by using assembly tolerance.

Advantages of the induction module according to the aforementioned embodiment will be described with reference to FIG. 9.

According to this embodiment, the permanent magnet housing 5500 for accommodating the permanent magnet 5130 and the cover housing 5600 jointed to the upper portion of the permanent magnet housing 5500 are provided separately. Therefore, the structure of the permanent magnet housing 5500 and the cover housing 5600 may be simplified.

Also, since the permanent magnet housing 5500 has not portion covering the upper portion, its structure and shape are relatively simple. Since the cover housing 5600 has no permanent magnet holder, its structure and shape are relatively simple. Therefore, the permanent magnet housing 5500 and the cover housing 5600 may make a simple structure of injection molding, and may minimize a defect during injection molding.

Also, the permanent magnet holder 5510 provided in the permanent magnet housing 5500 has a structure in which an upper portion is opened. Therefore, since the permanent magnet 5130 may be inserted into the permanent magnet holder 5510 from up to down, it is easy to mount the permanent magnet in the permanent magnet holder. Therefore, when the permanent magnet 5130 is damaged, the damaged permanent magnet may easily be replaced with a new one.

Also, since each of the permanent magnet housing 5500 and the cover housing 5600 may have a structure that may induce a natural convex current, it is easy to discharge heat generated from the coil 5150 to the outside.

Also, since the base housing 5100, the permanent magnet housing 5500 and the cover housing 5600 are jointed by the structure of the hook 5502, the joint force is increased.

It will be apparent to those skilled in the art that the present disclosure may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a cabinet;

a drum disposed inside the cabinet and configured to accommodate a treatment object, the drum being made of a metal material; and an induction module that is spaced apart from an outer circumferential surface of the drum and configured to heat the drum by induction, the induction module comprising:

a base housing that accommodates a coil, and a cover housing that is coupled to an upper portion of the base housing and that defines a guide space configured to transfer heat generated from the coil, wherein the cover housing defines a through portion that passes through the cover housing in a vertical direction toward the base housing and that is configured to discharge the heat generated from the coil, the cover housing comprising a first inclined section that is upwardly inclined toward the through portion with respect to a horizontal direction, and wherein the cover housing is configured to guide the heat generated from the coil along the first inclined section and discharge the heat to the through portion.

2. The laundry treating apparatus of claim 1, wherein the through portion is defined at an uppermost portion of the induction module.

3. The laundry treating apparatus of claim 2, wherein the through portion is defined at a center portion of the cover housing.

4. The laundry treating apparatus of claim 1, wherein the induction module further includes a magnet housing that is disposed between the base housing and the cover housing and that comprises a holder configured to accommodate a magnet therein.

5. The laundry treating apparatus of claim 4, wherein the holder comprises a plurality of holders, and wherein the magnet housing further comprises a connector that connects the plurality of holders to each other.

6. The laundry treating apparatus of claim 5, wherein the connector connects upper portions of the plurality of holders.

7. The laundry treating apparatus of claim 6, wherein the connector is spaced apart from the base housing to define a gap from the base housing, the gap being configured to discharge the heat generated from the coil.

8. The laundry treating apparatus of claim 4, wherein the magnet housing defines a through hole in communication with the through portion of the cover housing.

9. The laundry treating apparatus of claim 8, wherein the magnet housing comprises a second inclined section that is upwardly inclined toward the through hole with respect to the horizontal direction, and wherein the first inclined section is steeper than the second inclined section with respect to the horizontal direction.

10. The laundry treating apparatus of claim 9, wherein the base housing comprises a third inclined section that is upwardly inclined toward the through hole of the magnet housing with respect to the horizontal direction, and wherein the first inclined section is steeper than the third inclined section with respect to the horizontal direction.

11. The laundry treating apparatus of claim 10, wherein the base housing and the magnet housing comprise curved surfaces, respectively, the curved surfaces having a same curvature.

12. A laundry treating apparatus comprising:

a cabinet;

a drum disposed inside the cabinet and configured to accommodate a treatment object, the drum being made of a metal material; and an induction module that is spaced apart from an outer circumferential surface of the drum and configured to heat the drum by induction, the induction module comprising:

a base housing that accommodates a coil, and a cover housing that defines a guide space configured to transfer heat generated from the coil and that is coupled to an upper portion of the base housing, wherein the cover housing defines a through portion that passes through the cover housing in a vertical direction toward the base housing and that is configured to discharge the heat generated from the coil, and wherein the base housing and the cover housing have bent surfaces, respectively, and wherein the cover housing is configured to guide the heat generated from the coil along the bent surfaces and discharge the heat to the through portion.

13. The laundry treating apparatus of claim 12, wherein the induction module further comprises a magnet housing disposed between the base housing and the cover housing, the magnet housing comprising a holder configured to accommodate a magnet therein.

14. The laundry treating apparatus of claim 13, wherein the magnet housing and the base housing have curved surfaces, respectively, the curved surfaces having a same curvature.

15. The laundry treating apparatus of claim 12, further comprising a tub that accommodates the drum, wherein the base housing is fixed to an outer circumferential surface of the tub.

16. A laundry treating apparatus comprising:

a cabinet;

a tub disposed inside the cabinet;

a drum disposed inside the tub and configured to accommodate a target object, the drum being made of a metal material; and an induction module that is coupled to an outer circumferential surface of the tub and configured to heat the drum by induction, the induction module comprising:

a base housing that accommodates a coil and that faces the outer circumferential surface of the tub, a cover housing that is disposed vertically above the base housing and that is spaced apart from an upper surface of the based housing to thereby define a guide space configured to transfer heat generated from the coil, and a magnet housing disposed vertically between the base housing and the cover housing, the magnet housing defining a plurality of holders that pass through the magnet housing and that are configured to accommodate magnets, respectively, wherein the cover housing defines a through portion configured to discharge the heat from the guide space to an outside of the induction module.

17. The laundry treating apparatus of claim 16, wherein the plurality of holders are arranged about a center portion of the magnet housing, and wherein the through portion is defined at a position corresponding to the center portion of the magnet housing.

18. The laundry treating apparatus of claim 17, wherein the magnet housing further defines a center through hole at the center portion of the magnet housing, the center through hole being in communication with the through portion of the cover housing.

19. The laundry treating apparatus of claim 18, wherein the magnet housing further defines a plurality of through parts that are arranged about the center through hole and that pass through the magnet housing toward the base housing, each of the plurality of through parts being disposed between the plurality of holders.

20. The laundry treating apparatus of claim 19, wherein the cover housing covers the plurality of through parts of the magnet housing.

* * * * *